US009790016B2

(12) United States Patent
Ohyama

(10) Patent No.: US 9,790,016 B2
(45) Date of Patent: Oct. 17, 2017

(54) PACKAGING BAG FOR MICROWAVE OVENS

(71) Applicant: HOSOKAWA YOKO CO., LTD., Tokyo (JP)

(72) Inventor: Akira Ohyama, Kawasaki (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 0 days.

(21) Appl. No.: 15/221,774

(22) Filed: Jul. 28, 2016

(65) Prior Publication Data

US 2017/0029193 A1 Feb. 2, 2017

(30) Foreign Application Priority Data

Jul. 28, 2015 (JP) ..... 2015-148825
Jul. 28, 2015 (JP) ..... 2015-148826

(51) Int. Cl.

| | |
|---|---|
| ***B65D 33/01*** | (2006.01) |
| ***B65D 81/34*** | (2006.01) |
| ***B65D 65/40*** | (2006.01) |
| ***B65D 75/30*** | (2006.01) |
| ***B65D 75/58*** | (2006.01) |

(52) U.S. Cl.

CPC ..... *B65D 81/3461* (2013.01); *B65D 65/40* (2013.01); *B65D 75/30* (2013.01); *B65D 75/5805* (2013.01); *B65D 2205/025* (2013.01)

(58) Field of Classification Search

CPC .... B65D 81/3461; B65D 65/40; B65D 75/30; B65D 75/5805; B65D 2205/025

USPC ..... 383/101

See application file for complete search history.

(56) References Cited

U.S. PATENT DOCUMENTS

| | | | | |
|---|---|---|---|---|
| 6,121,597 | A * | 9/2000 | Igota | B65D 33/01 219/725 |
| 9,352,893 | B2 * | 5/2016 | Utz | B65D 77/225 |
| 9,371,159 | B2 * | 6/2016 | Hagino | B65D 81/3415 |
| 2007/0071855 | A1 * | 3/2007 | Kanzaki | B65D 81/3453 426/107 |
| 2007/0110856 | A1 * | 5/2007 | Kanzaki | B65D 77/225 426/107 |

FOREIGN PATENT DOCUMENTS

| | | | |
|---|---|---|---|
| JP | 08119343 | A * | 5/1996 |
| JP | 10310181 | A * | 11/1998 |
| JP | 2001180765 | A * | 7/2001 |
| JP | 2002-249176 | A | 9/2002 |
| JP | 2004115053 | A * | 4/2004 |
| JP | 2013086871 | A * | 5/2013 |

* cited by examiner

*Primary Examiner* — Jes F Pascua

(74) *Attorney, Agent, or Firm* — Nixon Peabody, LLP; Khaled Shami

(57) ABSTRACT

A packaging bag (10) for microwave ovens has a tube part (13) formed from a pair of resin film parts (11, 12) that each include a base material layer (21), a heat seal layer (23), and an intermediate layer (22) provided between the base material layer (21) and the heat seal layer (23) and are disposed to face each other such that the heat seal layer (23) becomes an inside thereof. At least one of the pair of resin film parts (11, 12) includes cutting lines (L1, L2, L3, L4), a temporarily fixed seal part (S), and an easy peeling part (S1), and the temporarily fixed seal part (S) is located at the easy peeling part (S1).

9 Claims, 14 Drawing Sheets

PACKAGING BAG FOR MICROWAVE OVENS

CROSS-REFERENCE TO RELATED APPLICATION

Priority is claimed on Japanese Patent Application Nos. 2015-148826 and 2015-148825, filed on Jul. 28, 2015, the contents of which are incorporated herein by reference.

BACKGROUND OF THE INVENTION

Field of the Invention

The present invention relates to a packaging bag for microwave ovens, in which food is housed and heated by a microwave oven.

Description of Related Art

As a packaging bag hermetically filled with food such as retort food or frozen food is heated by a microwave oven, the food is warmed or cooked. In this case, an internal pressure of the packaging bag is raised by water vapor or the like generated from the food along with the heating, and the packaging bag may burst. Accordingly, before the packaging bag is heated by a microwave oven, by, for example, partly opening the packaging bag in advance or by forming a hole in a packaging bag body as a countermeasure to prevent the bursting of the packaging bag, the water vapor or the like generated within the packaging bag along with the heating are usually discharged to the outside of the packaging bag. However, in this method, since the water vapor generated by the heating in the microwave oven is directly discharged to the outside of the packaging bag, heating and steaming effects caused by the water vapor are reduced, and a taste of the food is reduced.

Accordingly, for example, in Japanese Unexamined Patent Application, First Publication No. 2002-249176 (hereinafter referred to as Patent Document 1), a packaging bag is proposed in which water vapor generated by heating in a microwave oven is not directly discharged to the outside of the packaging bag and the water vapor can be automatically discharged to the outside after an internal pressure is raised to a certain extent. In the packaging bag described in Patent Document 1, a sealed circular vapor release part at which a pair of films facing each other are sealed is provided at a corner portion, and a through-hole is formed in the center of the sealed vapor release part. If the internal pressure of the packaging bag is raised by heating the packaging bag in the microwave oven, the sealed circular vapor release part is peeled. As a result, the inside and outside of the packaging bag communicate with each other through the through-hole, and vapor inside the packaging bag is discharged to the outside.

However, in the packaging bag described in Patent Document 1, when the through-hole is provided in the sealed vapor release part, a method of punching the sealed vapor release part with a punching device is mainly adopted. In this case, generation of an excised piece (a released gas) cannot be avoided. For this reason, in producing the packaging bag described in Patent Document 1, troublesome work of collecting all the excised pieces is required. If a leakage of the collection or the like occurs, there is a possibility of the excised piece being mixed into a product.

The present invention was conceived in view of the above-described circumstances, and an object of the present invention is to provide a packaging bag for microwave ovens in which, when an internal pressure of the packaging bag is raised by heating in a microwave oven, the inside and outside of the packaging bag can automatically communicate with each other to release the internal pressure to the outside, and an excised piece can be prevented from occurring in a process of producing the packaging bag.

SUMMARY OF THE INVENTION

To solve the above problems, the present invention adopts the following means.

A first aspect of the present invention is a packaging bag for microwave ovens, which has a tube part formed from a pair of resin film parts that each include a base material layer, a heat seal layer, and an intermediate layer provided between the base material layer and the heat seal layer and are disposed to face each other such that the heat seal layer becomes an inside thereof. At least one of the pair of resin film parts includes: a cutting line that is formed at the intermediate layer adjacent to one end or the other end of the tube part in a length direction and extends in a width direction of the resin film part; and a temporarily fixed seal part which is formed at a position at which the cutting line is formed and at which the heat seal layers of the pair of resin film parts disposed to face each other are heat-sealed. A specific region including a part of an edge of the resin film part includes an easy peeling part at which the base material layer and the intermediate layer are weakly adhered. The temporarily fixed seal part is located at the easy peeling part.

A second aspect of the present invention is the packaging bag of the first aspect in which the easy peeling part includes a first region formed close to the edge of the resin film part and a second region having a lesser peel strength than the first region and formed to be continuous with the first region, and the temporarily fixed seal part is located at the second region.

A third aspect of the present invention is the packaging bag of the first or second aspect in which a peel strength of the easy peeling part ranges from 0.01 to 5 N/15 mm.

A fourth aspect of the present invention is the packaging bag of any one of the first to third aspects, which is a four-sided sealed bag.

A fifth aspect of the present invention is the packaging bag of any one of the first to third aspects, which is a bottom gusset bag which includes a bottom material that is disposed at the one end of the tube part in the length direction and is heat-sealed.

A sixth aspect of the present invention is a packaging bag for microwave ovens, which has a tube part formed from a pair of resin film parts that each include a base material layer, a heat seal layer, and an intermediate layer provided between the base material layer and the heat seal layer and are disposed to face each other such that the heat seal layer becomes an inside thereof. At least one of the pair of resin film parts includes: a cutting line that is formed at the intermediate layer adjacent to one end or the other end of the tube part in a length direction and extends in a width direction of the resin film part; a temporarily fixed seal part which is formed at a position at which the cutting line is formed and at which the heat seal layers of the pair of resin film parts disposed to face each other are heat-sealed, an easy peeling part which is formed at a specific region including a part of an edge of the resin film part and at which the base material layer and the intermediate layer are weakly adhered; and a peeling part for guiding a peeling of the easy peeling part when the base material layer and the intermediate layer are peeled. The temporarily fixed seal part is located at the easy peeling part.

A seventh aspect of the present invention is the packaging bag of the sixth aspect in which the resin film part is rectangular, and the specific region is formed at one of corners of the resin film part.

An eighth aspect of the present invention is the packaging bag of the sixth or seventh aspect in which the peeling part is formed by a peeling coating provided on a surface of the base material layer which is close to the intermediate layer.

A ninth aspect of the present invention is the packaging bag of any one of the sixth to eighth aspects in which a peel strength of the easy peeling part ranges from 0.01 to 5 N/15 mm.

A tenth aspect of the present invention is the packaging bag of any one of the sixth to ninth aspects, which is a four-sided sealed bag.

A eleventh aspect of the present invention is the packaging bag of any one of the sixth to ninth aspects, which is a bottom gusset bag which includes a bottom material that is disposed at the one end of the tube part in the length direction and is heat-sealed.

According to the packaging bag for microwave ovens of the present invention, when an internal pressure is raised by heating of the packaging bag in a microwave oven, the inside and outside of the packaging bag can automatically communicate with each other, and the internal pressure can be released to the outside. It is also possible to prevent an excised piece from occurring in a process of producing the packaging bag.

DETAILED DESCRIPTION OF THE INVENTION

First Embodiment

Figure 1:
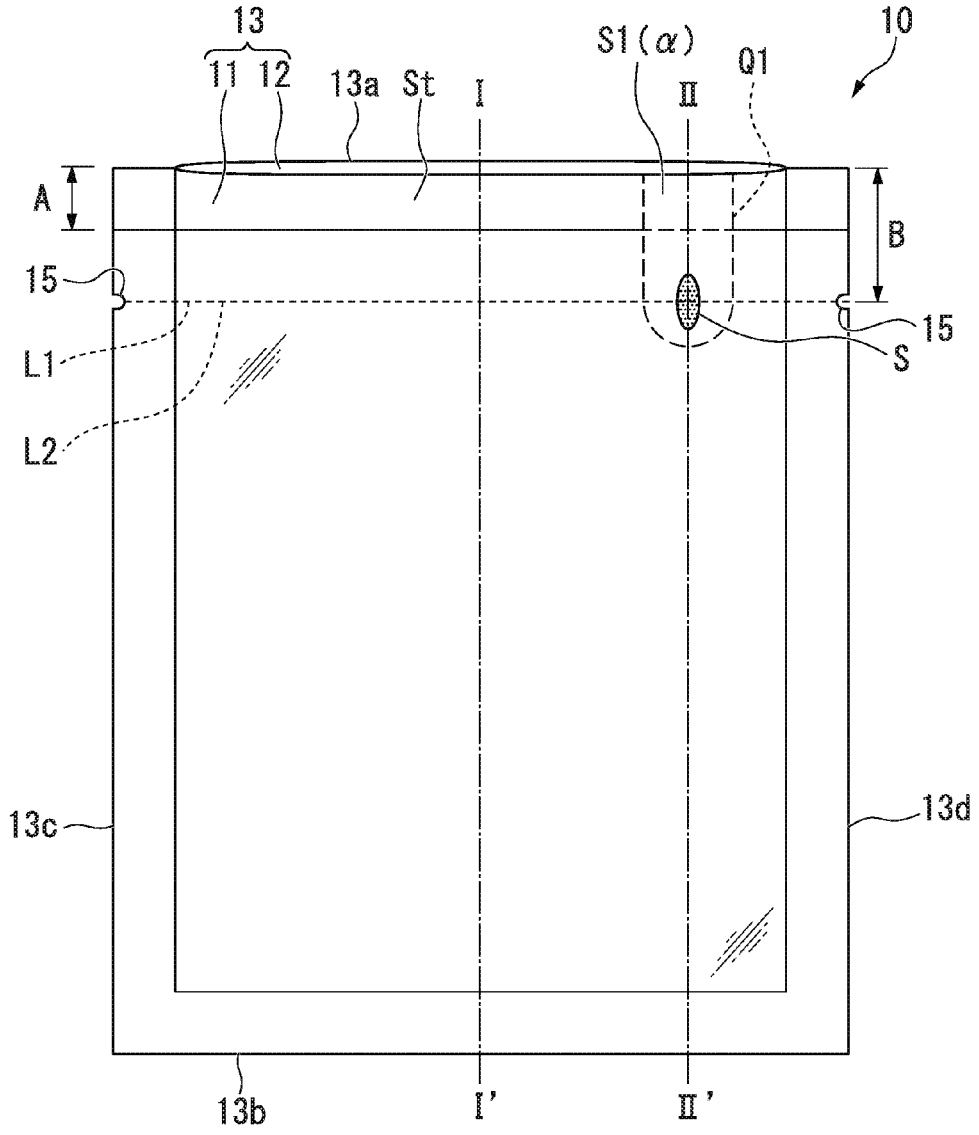
FIG. 1 is an appearance view illustrating a first embodiment of a packaging bag for microwave ovens of the present invention.
Figure 2:
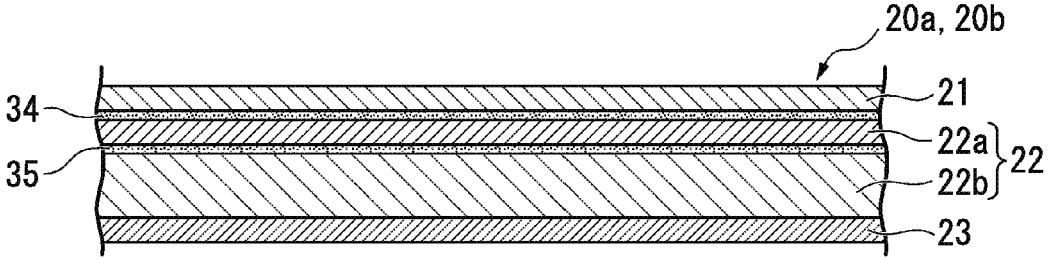
FIG. 2 is a cross-sectional view illustrating a layer constitution of a laminated film used to produce the packaging bag for microwave ovens of FIG. 1.
Figure 3:
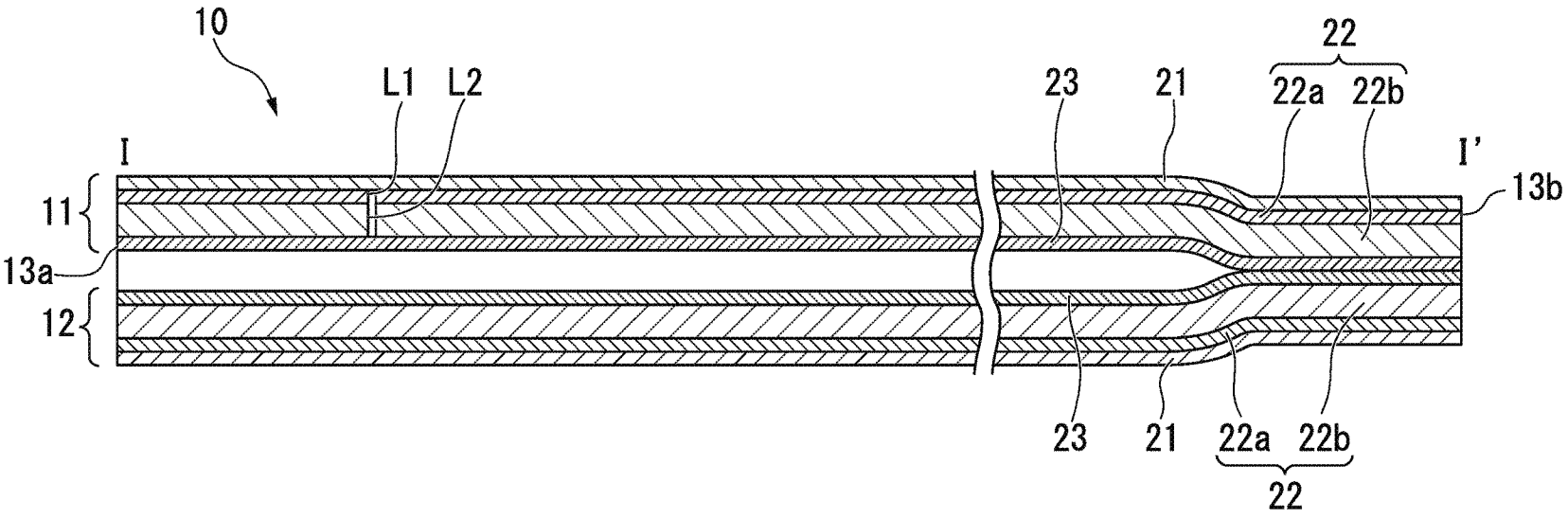
FIG. 3 is a cross-sectional view taken along line I-I' of FIG. 1.
Figure 4:
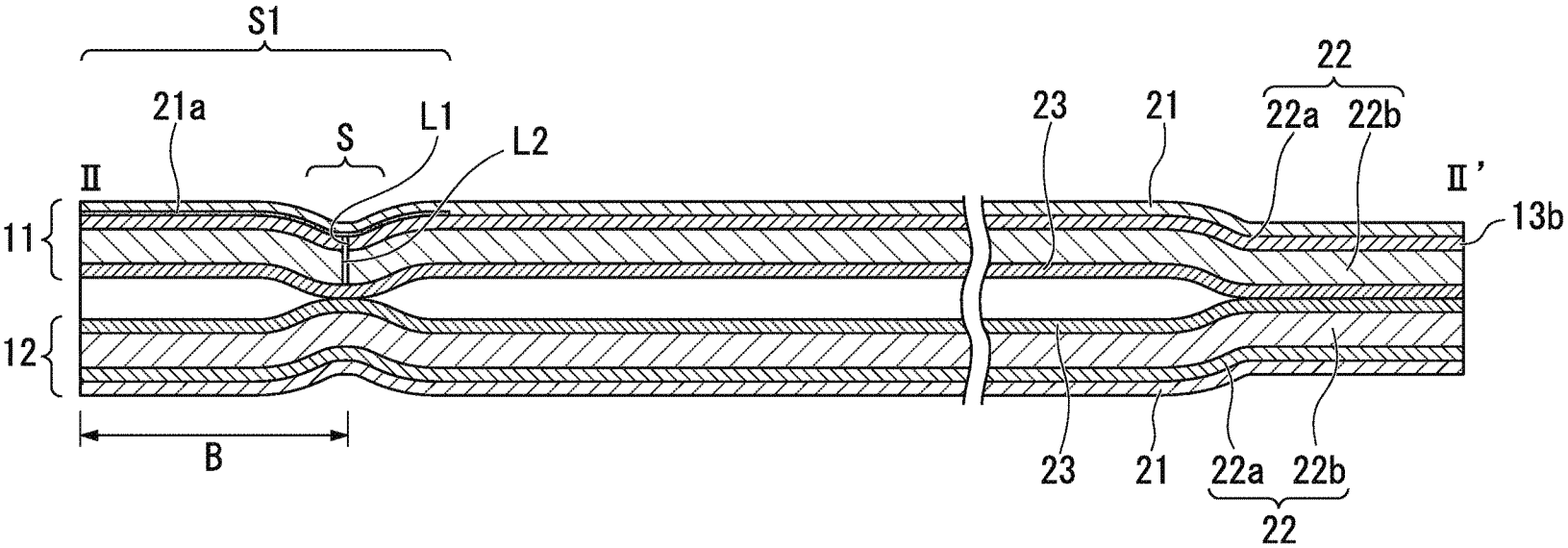
FIG. 4 is a cross-sectional view taken along line II-II' of FIG. 1.

Hereinafter, a first embodiment of the present invention will be described in detail. FIG. 1 is an appearance view illustrating a first embodiment of a packaging bag for microwave ovens (hereinafter referred to simply as "packaging bag") of the present invention, and FIG. 2 is a cross-sectional view illustrating a layer constitution of a laminated film used to produce the packaging bag of FIG. 1. FIG. 3 is a cross-sectional view taken along line I-I' of FIG. 1, and FIG. 4 is a cross-sectional view taken along line II-II' of FIG. 1. In the cross-sectional views of FIG. 3 and subsequent to FIG. 3, an adhesive agent layer is omitted from layers constituting the laminated film.

A packaging bag 10 of FIG. 1 has a tube part 13 formed from a pair of rectangular resin film parts 11 and 12. As also illustrated in FIG. 3, one end (an upper end in FIG. 1) 13*a* of the tube part 13 in a length direction is open and the other end (a lower end in FIG. 1) 13*b* is blocked by heat sealing. Note that the term "rectangular" used herein is a general term for a rectangle and a square. The open one end 13*a* is blocked by heat sealing after food to be heated is housed inside the packaging bag 10 therefrom. In this example, a region that is indicated by a reference sign St in FIG. 1 and has a length A from the one end 13*a* of the tube part 13 is a scheduled heat sealing region blocked by heat sealing after the food is housed therein.

The resin film parts 11 and 12 include laminated films 20*a* and 20*b* having a layer constitution illustrated in FIG. 2. The laminated films 20*a* and 20*b* of FIG. 2 each include a base material layer 21, a heat seal layer 23, and an intermediate layer 22 provided between these layers. The intermediate layer 22 may be made up of one layer or multiple layers. In this example, the intermediate layer 22 is made up of two layers, a first intermediate layer 22*a* located close to the base material layer 21 and a second intermediate layer 22*b* located close to the heat seal layer 23.

In this example, the base material layer 21 is a layer that is formed of a vapor deposited transparent polyethylene terephthalate (PET) film having a thickness of 12 μm and imparts strength and a gas barrier characteristic to the resin film parts 11 and 12. The vapor deposited transparent PET film is a transparent film in which a metal oxide or the like is vapor-deposited on at least one surface of a PET film and to which the gas barrier characteristic is imparted. The heat seal layer 23 is a sealant layer that is formed by extrusion lamination, is formed of polypropylene, and has a thickness of 20 μm. The first intermediate layer 22*a* is a layer that is formed of a biaxially oriented polyamide film having a thickness of 15 μm and imparts strength such as a pinhole resistance to the resin film parts 11 and 12. The second intermediate layer 22*b* is a layer that is formed of a non-oriented polypropylene film having a thickness of 50 μm and is joined with the heat seal layer 23 by thermal fusion.

The base material layer 21 and the first intermediate layer 22*a* are laminated via an adhesive agent layer 34. Similarly, the first intermediate layer 22*a* and the second intermediate layer 22*b* are also laminated via an adhesive agent layer 35. On the other hand, the heat seal layer 23 is formed on one surface of the second intermediate layer 22*b* by extrusion lamination, and no adhesive agent layer is provided between the heat seal layer 23 and the second intermediate layer 22*b*.

To be specific, as will be described below, in a rectangular laminated film 20*a* constituting the resin film part 11 of the resin film parts 11 and 12, a film in which an adhesion inhibition coating, which is not illustrated in FIG. 2, is provided on a surface of the base material layer 21 which is close to the first intermediate layer 22*a* is used at one place including an edge thereof.

Since the resin film parts 11 and 12 forming the packaging bag 10 of FIG. 1 has the heat seal layer 23 as described above, the resin film part 11 and the resin film part 12 are disposed opposite to each other such that the respective heat seal layers 23 become an inside thereof. The heat seal layers 23 disposed opposite to each other are formed in a bag shape as the other end 13*b* of the tube part 13 in the length direction and opposite ends (both lateral ends) 13*c* and 13*d* of the tube part 13 in a width direction are heat-sealed and blocked.

At the resin film part 11 of the resin film parts 11 and 12, continuous linear cutting lines L1 and L2 that extend in the width direction (a transverse direction in FIG. 1) are formed at the first and second intermediate layers 22*a* and 22*b* at positions corresponding to each other, respectively. The cutting line L1 is formed by passing through the first intermediate layer 22*a* in a thickness direction, and the cutting line L2 is formed by passing through the second intermediate layer 22*b* in the thickness direction.

In this example, the cutting lines L1 and L2 are formed from one lateral end 13*c* to the other lateral end 13*d* of the resin film part 11 in the vicinity of the one end 13*a* of the tube part 13. For this reason, the cutting lines L1 and L2 of this example function as unsealing lines when food housed in the packaging bag 10 is removed. Reference signs 15 in FIG. 1 indicate notches that become unsealing start points formed at ends of the cutting lines L1 and L2. Here, the term "the vicinity of the one end of the tube part" is a region that has a length B of 30% from the one end 13*a* of the tube part 13 when a full length of the tube part 13 is set to 100% and that is closer to the center of the tube part 13 in the length direction than the scheduled heat sealing region St. The term "the vicinity of the other end of the tube part" is also a region that has a length of 30% from the other end 13*b* of the tube part 13 when the full length of the tube part 13 is set to 100% and that is closer to the center of the tube part 13 in the length direction than the scheduled heat sealing region St. The length 13 is preferably set, for instance, within a range of 10 to 50 mm. The length B is longer than the length A.

As illustrated in FIG. 1, at the resin film part 11 at which the cutting lines L1 and L2 are formed, a region (a specific region) α including a part of the edge thereof includes an easy peeling part S1 at which the base material layer 21 and the first intermediate layer 22*a* are weakly adhered so as to be peelable. To be specific, as will be described below, the easy peeling part S1 is a part at which, when the internal pressure of the packaging bag 10 is raised by water vapor or the like generated from food when the packaging bag 10 is heated by a microwave oven, the base material layer 21 and the first intermediate layer 22*a* are automatically peeled.

The easy peeling part S1 is formed in such a manner that an adhesion inhibiting coating 21*a* for weakening an adhesive force to the adhesive agent layer 34 is provided on the surface of the base material layer 21 which is close to the first intermediate layer 22*a*. Thereby, the base material layer 21 and the first intermediate layer 22*a* are made peelable at the easy peeling part S1. The adhesion inhibiting coating 21*a* is formed from a peeling agent containing at least one selected from the group consisting of, for example, a nitrocellulose, an acrylic resin, a polyamide resin, a silicone resin, and so on.

A peel strength between the base material layer 21 and the first intermediate layer 22*a* at the easy peeling part S1 is preferably set within a range of 0.01 to 5 N/15 mm, and more preferably 0.1 to 3 N/15 mm. If the peel strength is equal to or higher than 0.01 N/15 mm, which is the lower limit of the range, the base material layer 21 and the first intermediate layer 22*a* of the easy peeling part S1 are not easily peeled when the packaging bag 10 goes through a disinfection treatment by boiling or retorting after food is housed and sealed in the packaging bag 10 or when the packaging bag 10 is distributed after the disinfection treatment. On the other hand, if the peel strength is equal to or lower than 3 N/15 mm, which is the upper limit of the range, when the internal pressure of the packaging bag 10 is raised by water vapor generated from food when the packaging bag 10 is heated by a microwave oven, the base material layer 21 and the first intermediate layer 22*a* of the easy peeling part S1 are automatically and more easily peeled. The "peel strength" used therein indicates a value measured by a 180-degree peel test conforming to JIS K 6854.

In this example, the region α which includes the easy peeling part S1 is a region formed to include a part of the one end 13*a* of the tube part 13 of the resin film part 11 that is in a rectangular shape. A reference sign Q1 in FIG. 1 is a line indicating a boundary between the region α at the resin film part 11 and a region other than the region α.

The easy peeling part S1 is provided such that, as the base material layer 21 thereof is peeled from the first intermediate layer 22*a*, the first intermediate layer 22*a* of a portion at which a temporarily fixed seal part S, which will be described below, is formed, can communicate with the outside of the packaging bag 10. For this reason, it is enough to form the easy peeling part S1 to be able to achieve this object, and it is not necessary that the easy peeling part S1 is provided with an area larger than necessary. The easy peeling part S1 is preferably provided with an area within a range of 30% or less, for example, when an area of the resin film part 11 is set to 100%, more preferably 20% or less, and most preferably 15% or less. If the area is within this range, even if the base material layer 21 of the easy peeling part S1 is peeled from the first intermediate layer 22*a* by a shock or the like during distribution, a reduction in a gas barrier characteristic, strength, etc. can be minimized.

As illustrated in FIG. 4, the temporarily fixed seal part S at which the heat seal layer 23 of the resin film part 11 and the heat seal layer 23 of the resin film part 12 are heat-sealed in a pointed shape is formed at one place at the positions at which the cutting lines L1 and L2 are formed. The temporarily fixed seal part S is located at the easy peeling part S1 of the region α. To be specific, as will be described below, when the internal pressure of the packaging bag 10 is raised by heating the packaging bag 10 with a microwave oven after food is housed therein and the scheduled heat sealing region St is blocked, the temporarily fixed seal part S is a part that functions as a vapor passing part at which a seal is broken and the internal pressure is released to the outside of the packaging bag 10. In this example, the temporarily fixed seal part S is formed in an oval shape in which a major diameter thereof in the length direction of the tube part 13 is about 6 mm, and a minor diameter perpendicular to the major diameter is about 4 mm.

The packaging bag 10 illustrated in FIG. 1 is produced by a method having a process of producing the laminated film 20*a* constituting the resin film part 11 and the laminated film 20*b* constituting the resin film part 12, and a process of producing a bag from the produced laminated films 20*a* and 20*b*.

First, the laminated film 20*a* constituting the resin film part 11 at which the cutting lines L1 and L2 are formed is produced as follows. To be specific, a non-oriented polypropylene film is prepared. Next, a cutting line having a continuous linear shape is formed at a predetermined position (a position that is close to the one end 13*a* of the tube part 13) of the non-oriented polypropylene film. Thereby, the second intermediate layer 22*b* at which the cutting line L2 is formed is obtained. Next, polypropylene is extrusion-laminated to form the heat seal layer 23 on the one surface of the second intermediate layer 22*b* at which the cutting line L2 is formed. Thereby, a laminate (i) of the second intermediate layer 22*b* and the heat seal layer 23 is produced.

The process of forming the linear cutting line at the non-oriented polypropylene film and the process of extrusion-laminating the polypropylene may be continuously performed. That is, the non-oriented polypropylene film may be transported, the cutting line may be formed upstream in a flow direction of the non-oriented polypropylene film, and then the polypropylene may be extrusion-laminated downstream. In this case, the cutting line is formed in parallel with the flow direction of the non-oriented polypropylene film.

A vapor deposited transparent PET film is separately prepared. Next, the adhesion inhibiting coating 21*a* is formed at a part (the region α) including an edge of one surface of the vapor deposited transparent PET film. Thereby, the base material layer 21 having a region becoming the easy peeling part S1 is obtained. Further, a biaxially oriented polyamide film is separately prepared. Next, a cutting line having a continuous linear shape is formed at a predetermined position (a position that is close to the one end 13*a* of the tube part 13) of the biaxially oriented polyamide film. Thereby, the first intermediate layer 22*a* at which the cutting line L1 is formed is obtained. Next, the vapor deposited transparent PET film is adhered to the biaxially oriented polyamide film by an adhesive agent (an adhesive agent corresponding to the adhesive agent layer 34), and a laminate (ii) of the base material layer 21 and the first intermediate layer 22*a* is produced. Here, the vapor deposited transparent PET film and the biaxially oriented polyamide film are adhered such that the surface of the vapor deposited transparent PET film on which the adhesion inhibiting coating 21*a* is formed is opposite to the biaxially oriented polyamide film. Afterwards, the second intermediate layer 22*b* of the laminate (i) and the first intermediate layer 22*a* of the laminate (ii) are adhered by an adhesive agent (an adhesive agent corresponding to the adhesive agent layer 35). In this way, the laminated film 20*a* constituting the resin film part 11 at which the cutting lines L1 and L2 are formed is produced.

The process of forming the linear cutting line at the biaxially oriented polyamide film and the process of adhering the vapor deposited transparent PET film to the biaxially oriented polyamide film with the adhesive agent may be continuously performed. That is, the biaxially oriented polyamide film may be transported, the cutting line may be formed upstream in a flow direction of the biaxially oriented polyamide film, and then the vapor deposited transparent PET film may be adhered downstream. In this case, the cutting line is formed by extending in parallel with the flow direction of the biaxially oriented polyamide film.

On the other hand, the laminated film 20*b* constituting the resin film part 12 can be produced by the same method as the laminated film 20*a* except that the cutting lines L1 and L2 are not formed and that the adhesion inhibiting coating 21*a* is not formed.

Next, the laminated films 20*a* and 20*b* are formed into a bag, and the packaging bag 10 of FIG. 1 is produced. First, the laminated film 20*a* and the laminated film 20*b* are superimposed on each other such that the heat seal layers 23 are opposite to each other. Next, among peripheral edges of the laminated films 20*a* and 20*b*, three peripheral edges (three sides) other than one peripheral edge (one side) corresponding to the one end 13*a* of the tube part 13 are blocked by heat sealing. At this point, point sealing is performed at a predetermined position except the blocked places, and a temporarily fixed seal part S is formed. Thereby, the packaging bag 10 illustrated in FIG. 1 can be produced.

After food is housed in the packaging bag 10 produced in this way, a scheduled heat sealing region St at the one end 13*a* of the tube part 13 is heat-sealed. Thereby, a food-containing packaging bag is obtained. The obtained food-containing packaging bag can be distributed to a market.

Figure 5:
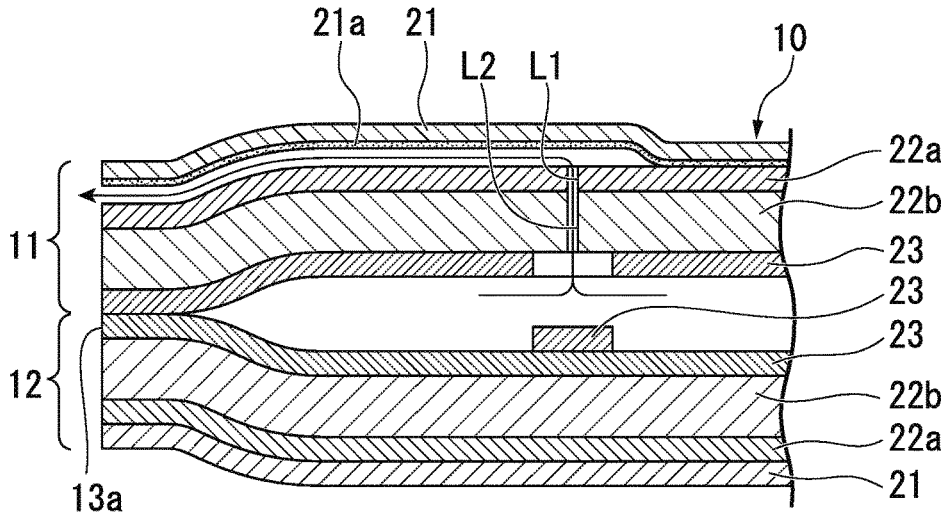
FIG. 5 is a cross-sectional view illustrating how water vapor generated from food inside the packaging bag for microwave ovens is discharged to the outside when the packaging bag for microwave ovens of FIG. 1 is heated by a microwave oven.

When consuming the food in the food-containing packaging bag, a person who consumes the food puts the food-containing packaging bag into a microwave oven, and starts heating. Then, as illustrated in FIG. 5, an internal pressure begins to be raised by water vapor or the like generated by the heating in the microwave oven. When the internal pressure is raised to a certain extent, stress is concentrated on the temporarily fixed seal part S inside the food-containing packaging bag. Thereby, the thermal fusion between the heat seal layers 23 at the temporarily fixed seal part S is broken. Here, since the heat seal layer 23 of the resin film part 11 and the heat seal layer 23 of the resin film part 12 are formed of the same resin, they are strongly joined. For this reason, when the thermal fusion of the temporarily fixed seal part S is broken, as illustrated in FIG. 5, peeling occurs not between the heat seal layer 23 of the resin film part 11 and the heat seal layer 23 of the resin film part 12 but between the second intermediate layer 22*b* of the resin film part 11 and the heat seal layer 23 of the resin film part 11 that is weakened by the formation of the cutting lines L1 and L2. That is, the heat seal layer 23 of the resin film part 11 at which the cutting lines L1 and L2 are formed is broken. To be specific, a part of the heat seal layer 23 of the resin film part 11 which is located at a portion corresponding to the cutting lines L1 and L2 is pulled by the heat seal layer 23 of the resin film part 12 which is strongly joined thereto and is peeled from the heat seal layer 23 of the resin film part 11. As a result, the peeled part of the heat seal layer 23 of the resin film part 11 is brought into a state in which it is transited from the heat seal layer 23 of the resin film part 11 at which the cutting lines L1 and L2 are formed to the heat seal layer 23 of the resin film part 12 at which the cutting lines L1 and L2 are not formed.

In this way, when the heat seal layer 23 of the resin film part 11 which is located at the portion corresponding to the cutting lines L1 and L2 is peeled at the temporarily fixed seal part S, the second intermediate layer 22*b* of the portion corresponding to the cutting lines L1 and L2 is exposed inside the packaging bag 10. As a result, the water vapor or the like generated inside the food-containing packaging bag passes through the cutting line L2 of the second intermediate layer 22*b*, the adhesive agent layer, illustration of which is omitted, the cutting line L1 of the first intermediate layer 22*a*, and the adhesive agent layer, illustration of which is omitted, as indicated by an arrow in FIG. 5. As the water vapor or the like acts to press the base material layer 21 outward, peeling occurs between the base material layer 21 and the first intermediate layer 22*a* at the easy peeling part S. The water vapor or the like is discharged from the inside to the outside of the food-containing packaging bag 10 through a gap formed by this peeling.

For this reason, according to this packaging bag 10, even when the internal pressure is raised by the water vapor or the like generated from the food by the heating in the microwave oven, the packaging bag 10 does not burst. The water vapor or the like is not directly discharged to the outside of the packaging bag 10 but is automatically discharged to the outside of the packaging bag 10 after the internal pressure is raised to a certain extent since the water vapor or the like begins to be generated. For this reason, since heating and steaming effects caused by the water vapor are obtained, a taste of the food is excellent. In the method of forming the temporarily fixed seal part S as the member for releasing the internal pressure in this way, it is not necessary to form a hole with, for instance, a punching device, and no excised piece (no released gas) occurs. Accordingly, troublesome work of collecting the excised piece is not required, and there is no risk of the excised piece being mixed into the packaging bag 10 that is a product.

As the easy peeling part S1 is automatically peeled, the generated water vapor or the like is caused to pass through the cutting lines L1 and L2 and is released to the outside of the packaging bag 10. For this reason, before a user heats the food-containing packaging bag with the microwave oven, there is no need to do any work. During distribution of the food-containing packaging bag, the easy peeling part S1 is not peeled. For this reason, during the distribution of the food-containing packaging bag, it is possible to not only suppress degradation of the food but also sufficiently protect the first and second intermediate layers 22*a* and 22*b* at which the cutting lines L1 and L2 are formed.

Figure 6:
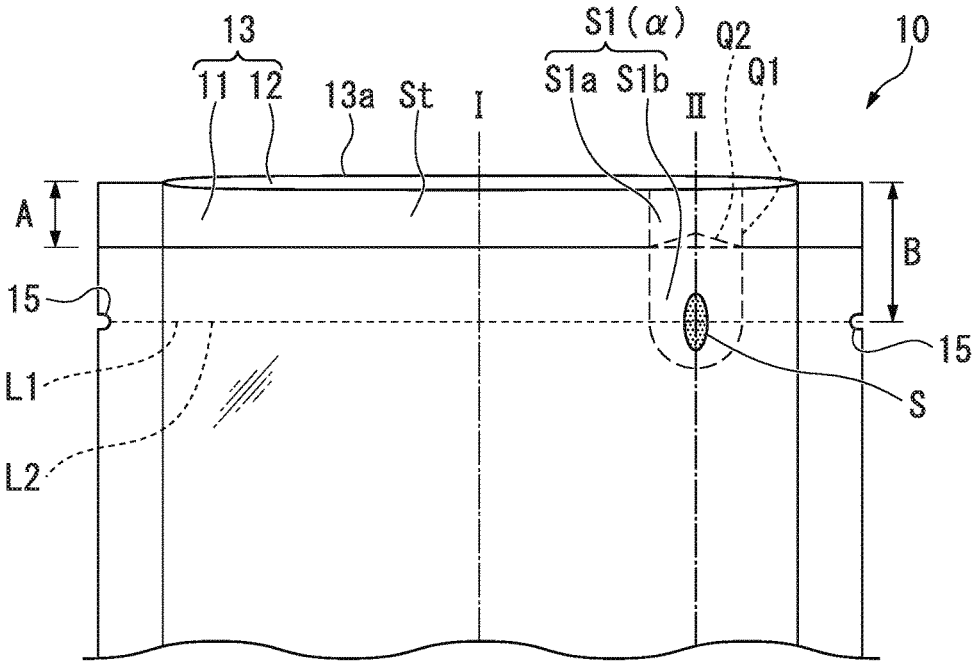
FIG. 6 is an appearance view illustrating a modification of an easy peeling part formed at the packaging bag for microwave ovens.

In the first embodiment described above, the entire region of the easy peeling part S1 is formed with uniform peel strength. However, as illustrated in FIG. 6, the easy peeling part S1 may be formed by two regions, a first region S1*a* having greater peel strength and a second region S1*b* having lesser peel strength than the first region S1*a*. The first region S1*a* is formed close to the edge of the resin film part 11. The second region S1*b* is provided to be continuous with the first region S1*a*. The temporarily fixed seal part S is formed on the second region S1*b*. The peel strengths of the first region S1*a* and the second region S1*b* are set within the range of the aforementioned favorable peel strength, i.e. preferably within the range of 0.01 to 5 N/15 mm, and more preferably within the range of 0.1 to 3 N/15 mm, such that the first region S1*a* is greater than the second region S1*b*. To be specific, it is preferable to set the peel strength of the first region S1*a* to range from 0.5 to 3 N/15 mm, and to set the peel strength of the second region S1*b* to be less than 0.5 N/15 mm.

In this way, as the first region S1*a* having the greater peel strength is formed close to the edge, intrusion of hot water into the easy peeling part S1 during retort disinfection, peeling of the easy peeling part S1 in the event of deformation of the packaging bag such as bending of the packaging bag during distribution, and so on can be effectively prevented. Thereby, during a preservation period of a content such as food, degradation of the content such as food due to reduction in barrier characteristic of the packaging bag can be prevented in advance. On the other hand, the temporarily fixed seal part S is formed on the second region S1*b* having the lesser peel strength. For this reason, a portion of the easy peeling part S1 which is located on the second region S1*b* is more smoothly peeled from the first intermediate layer 22*a* by the generation of water vapor or the like, and thus the water vapor or the like is more easily discharged from the inside to the outside of the packaging bag 10. As illustrated in FIG. 6, a shape of a boundary line Q2 between the first region S1*a* and the second region S1*b* is changed to a V shape or the like rather than a linear shape. Thereby, it is possible to change a time required until passage of steam is initiated after the internal pressure begins to be raised by the generated water vapor or the like. That is, as the shape of the boundary line Q2 is changed to the V shape or the like, the time required until the passage of steam is initiated can be finely controlled according to properties of the content such as food.

The first region S1*a* and the second region S1*b* that have different peel strengths are, for example, formed by methods (1) and (2) represented below. As the method (1), a peeling agent containing a silicone resin having a greater effect of impeding adhesion is used for the formation of the second region S1*b*, and a peeling agent containing an acrylic resin having a smaller effect of impeding adhesion than the silicone resin is used for the formation of the first region S1*a*. Thereby, a combination of the peeling agent used for the first region S1*a* and the peeling agent used for the second region S1*b* is adjusted. As the method (2), the same type of peeling agent is used for the formation of the first region S1*a* and the formation of the second region S1*b*. However, an amount of application (per unit area) of the peeling agent on the second region S1*b* for which the effect of impeding adhesion is further required is more than that of the peeling agent for forming the first region S1*a*.

In the first embodiment described above, the intermediate layer 22 is formed from the two layers, the first intermediate layer 22*a* and the second intermediate layer 22*b*. The second intermediate layer 22*b* located close to the heat seal layer 23 is formed of the same type of resin as the heat seal layer 23, and is joined by thermal fusion with the heat seal layer 23 without interposing an adhesive agent layer. For this reason, as described above, when the thermal fusion of the temporarily fixed seal part S is broken, the second intermediate layer 22*b* is exposed, whereas an adhesive agent layer is not exposed. For this reason, even if the thermal fusion of the temporarily fixed seal part S is broken in this way, food does not come into contact with an adhesive agent layer, which is favorable from the viewpoint of food sanitation.

In the first embodiment described above, the cutting lines L1 and L2 also function as unsealing lines for unsealing the packaging bag 10 to take out the food. For this reason, when the packaging bag 10 is produced, the temporarily fixed seal part S may be provided on the cutting lines L1 and L2 functioning as the unsealing lines, and the cutting lines for the passage of steam may not be separately formed. However, the cutting lines may be provided separately from the unsealing lines, and the temporarily fixed seal part may be provided on the cutting lines. In this case, the cutting lines may be formed at the portion at which at least the temporarily fixed seal part is provided, and may not be formed from the one lateral end 13*c* to the other lateral end 13*d* of the resin film part 11.

In the first embodiment described above, the temporarily fixed seal part S is provided only at one place. This temporarily fixed seal part S may be provided at two or more places. However, when the temporarily fixed seal part S is provided only at one place in this way, stress is effectively concentrated on the one temporarily fixed seal part S due to a rise in internal pressure, and thereby the thermal fusion of the temporarily fixed seal part S is easily smoothly broken.

In the first embodiment described above, the shape of the temporarily fixed seal part S is an oval shape that is long in the length direction of the tube part 13, but the shape of the temporarily fixed seal part S is not limited to the oval shape. The shape of the temporarily fixed seal part S may be another shape such as a completely circular shape, a rectangular shape, or the like. However, it is preferable that the shape of the temporarily fixed seal part S is a longitudinally long oval shape in this way, because, even if the position at which the temporarily fixed seal part S is provided in the event of the production of the packaging bag 10 is somewhat shifted in the length direction of the packaging bag 10, the temporarily fixed seal part S is easily formed to be located on the cutting lines L1 and L2. In addition, an area of the one temporarily fixed seal part S can be adequately set according to a size of the packaging bag 10, a type and amount of the content such as food, and so on, but it is preferably set within a range of 0.01 to 2 $cm^2$.

Figure 7A:
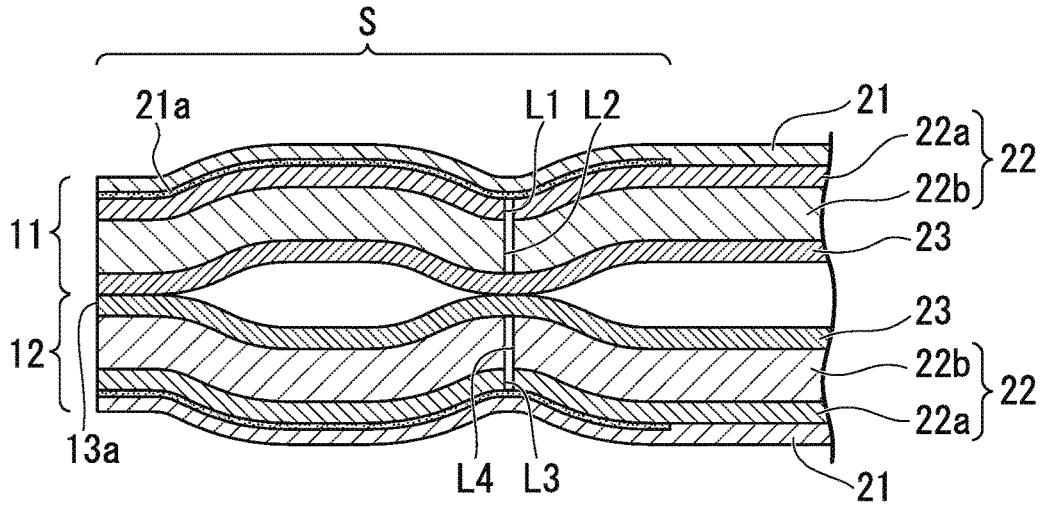
FIG. 7A is a cross-sectional view illustrating essential parts of a modification of the packaging bag for microwave ovens.

In the first embodiment described above, the cutting lines L1 and L2 are provided for the one resin film part 11. However, as illustrated in FIG. 7A, cutting lines L3 and L4 may also be provided for the intermediate layer 22 of the other resin film part 12. In this case, the cutting lines L1 and L2 at the one resin film part 11 and the cutting lines L3 and L4 at the other resin film part 12 are provided at positions corresponding to each other (positions opposite to each other in a direction orthogonal to the length and width directions of the tube part 13). The temporarily fixed seal part S is formed at each of the positions at which the cutting lines L1, L2, L3 and L4 of both of the resin film parts 11 and 12 are formed. The region α made up of the easy peeling part S1 is formed at each of the resin film parts 11 and 12.

Figure 7B:
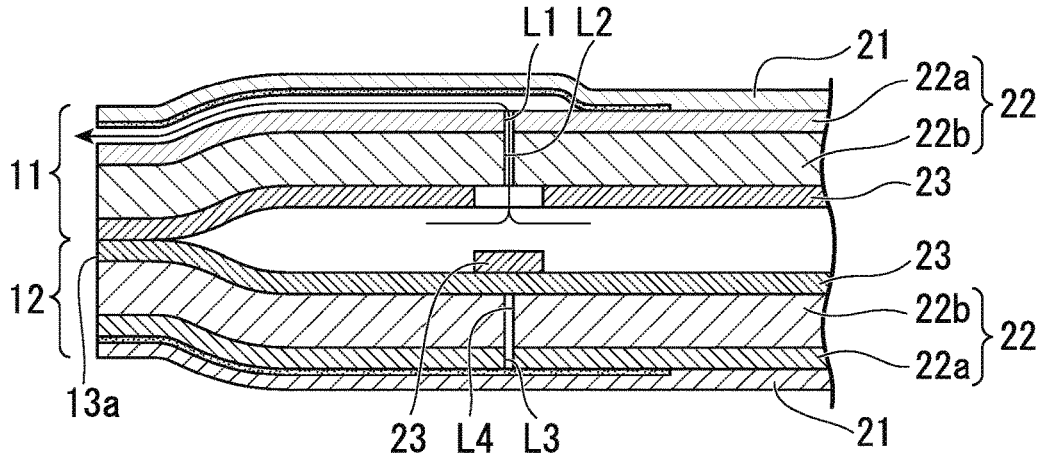
FIG. 7B is a cross-sectional view illustrating an example of how the water vapor generated from the food inside the packaging bag for microwave ovens is discharged to the outside when the packaging bag for microwave ovens of FIG. 7A is heated by a microwave oven.
Figure 7C:
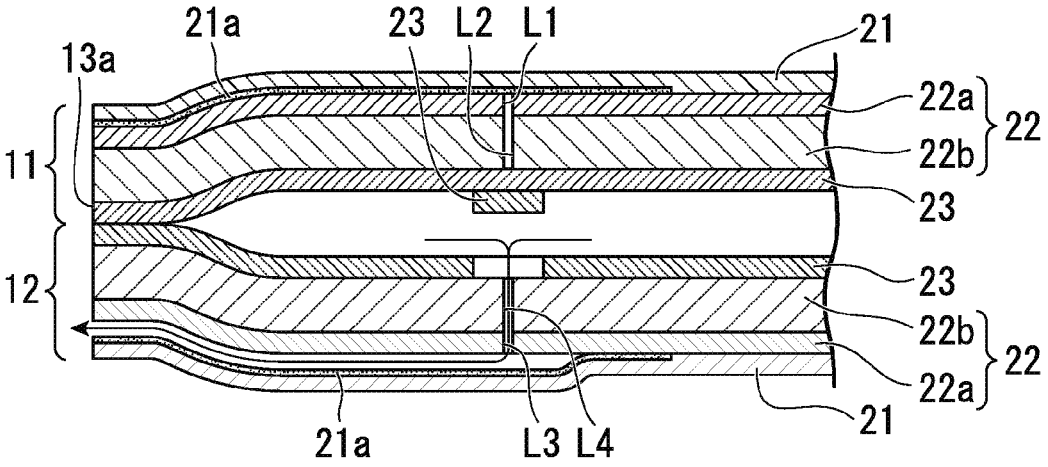
FIG. 7C is a cross-sectional view illustrating another example of how the water vapor generated from the food inside the packaging bag for microwave ovens is discharged to the outside when the packaging bag for microwave ovens of FIG. 7A is heated by a microwave oven.

In this way, when the cutting lines L1 L2, L3 and L4 are provided for both of the resin film parts 11 and 12, if the internal pressure of the packaging bag 10 is raised, the heat seal layer 23 is broken such that the second intermediate layer 22*b* at the resin film part 11 is exposed as illustrated in FIG. 7B, or the heat seal layer 23 is broken such that the second intermediate layer 22*b* at the resin film part 12 is exposed as illustrated in FIG. 7C. In the case of FIG. 7B, the water vapor or the like is discharged to the outside through the cutting lines L1 and L2. In the case of FIG. 7C, the water vapor or the like is discharged to the outside through the cutting lines L3 and L4. In this way, when the cutting lines L1, L2, L3 and L4 are provided for both of the resin film parts 11 and 12, the water vapor or the like can be more reliably discharged to the outside of the packaging bag 10.

Figure 8:
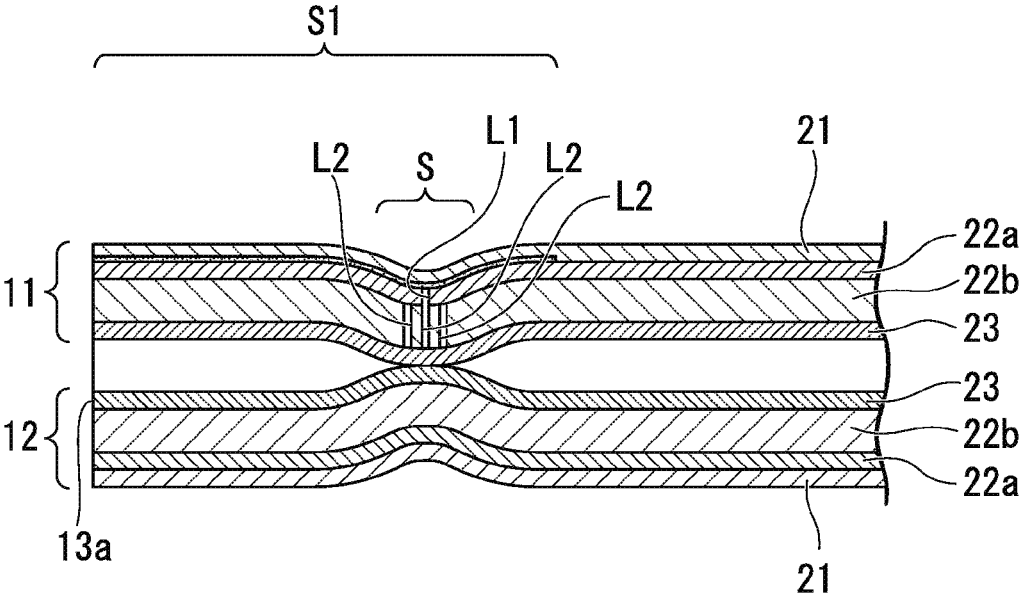
FIG. 8 is a cross-sectional view illustrating a modification of cutting lines formed at the packaging bag for microwave ovens.

Further, the cutting lines may be either intermittent cutting lines (perforations) such as dotted lines for which cut portions and uncut portions are alternately repeated, or continuous slit-like cutting lines made up of only cut portions. In this example, the cutting lines L1 and L2 are formed at the first and second intermediate layers 22*a* and 22*b*, respectively. However, the number of cutting lines formed at each of the first and second intermediate layers 22*a* and 22*b* is not limited to one, and may be two or more that are parallel to each other. Moreover, the number of cutting lines formed at the first intermediate layer 22*a* and the number of cutting lines formed at the second intermediate layer 22*b* may not be the same number. For example, as illustrated in FIG. 8, one cutting line L1 may be formed at the first intermediate layer 22*a*, and three cutting lines L2 may be formed at the second intermediate layer 22*b*. In this way, if a plurality of cutting lines L2 are formed at the second intermediate layer 22*b*, an adhesion strength between the heat seal layer 23 and a portion at which the cutting lines L2 are formed at the second intermediate layer 22*b* is made weaker than that between the heat seal layer 23 and a portion at which the cutting lines are not formed at the second intermediate layer 22*b*. As a result, when the internal pressure is raised, it is easy for the peeling to occur reliably between the second intermediate layer 22*b* of the resin film part 11 and the heat seal layer 23 of the resin film part 11. In this way, when the plurality of cutting lines are formed at one or more of the first intermediate layer 22*a* and the second intermediate layer 22*b*, at least one of the cutting lines formed at the first intermediate layer 22*a* and at least one of the cutting lines formed at the second intermediate layer 22*b* need to be provided at mutually corresponding positions (positions opposite to each other in the direction orthogonal to the length and width directions of the tube part 13). Moreover, when the plurality of cutting lines are formed at one or more of the first intermediate layer 22*a* and the second intermediate layer 22*b*, an interval between neighboring cutting lines depends on a size of the temporarily fixed seal part S, but is preferably equal to or less than 2 mm. Both of the number of cutting lines formed at the first intermediate layer 22*a* and the number of cutting lines formed at the second intermediate layer 22*b* preferably range from one to five.

In the first embodiment described above, the vapor deposited transparent PET film is used for the base material layer 21, but the base material layer 21 is not limited thereto. For example, a film formed of polyester such as PET, polyamide, polypropylene, or the like may be used for the base material layer 21. Moreover, a multilayered film obtained by co-extruding two or more materials may be used. The film used for the base material layer 21 is preferably a biaxially oriented film from the viewpoint of strength, and so on. A vapor deposited film on which a metal oxide is vapor-deposited, or a barrier film for which a thin film layer having a gas barrier characteristic of, for instance, an ethylene-vinyl alcohol copolymer is provided may be used. A thickness of the film constituting the base material layer 21 is preferably set, for instance, within a range of 6 to 50 μm, and more preferably 9 to 30 μm.

In the first embodiment described above, the biaxially oriented polyamide film is used for the first intermediate layer 22*a*, but the first intermediate layer 22*a* is not limited thereto. For example, a film formed of polyester, polypropylene, or the like in addition to polyamide may be used for the first intermediate layer 22*a*. Moreover, a multilayered film obtained by co-extruding two or more materials may be used. The film used for the first intermediate layer 22*a* is preferably a biaxially oriented film from the viewpoint of strength, and so on. A vapor deposited film on which a metal oxide is vapor-deposited, or a barrier film for which a thin film layer having a gas barrier characteristic of, for instance, an ethylene-vinyl alcohol copolymer is provided may be used. A thickness of the film constituting the first intermediate layer 22*a* is preferably set, for instance, within a range of 6 to 50 μm, and more preferably 9 to 30 μm.

The adhesive agent constituting the adhesive agent layers 34 and 35 may include adhesive agents based on, for example, polyester, polyether, polyurethane, and so on.

Since the second intermediate layer 22*b* and the heat seal layer 23 are thermally fused to each other without interposing an adhesive agent layer, the second intermediate layer 22*b* and the heat seal layer 23 are preferably formed of polyolefin such as polypropylene, polyethylene, or the like. The second intermediate layer 22*b* and the heat seal layer 23 may be a multilayered film obtained by co-extruding two or more materials including polyolefin and so on. As described above, the heat seal layer 23 may be formed on the one surface of the second intermediate layer 22*b* by extrusion lamination. A thickness of the second intermediate layer 22*b* is preferably set within a range of 10 to 150 μm, and more preferably 20 to 100 μm. A thickness of the heat seal layer 23 is preferably set within a range of 10 to 100 μm, and more preferably 15 to 50 μm.

In the first embodiment described above, a four-sided sealed bag in which four edges (four sides) are finally sealed and blocked is shown as the packaging bag 10. However, the packaging bag 10 may be a bottom gusset bag, for example, in which a bottom member is disposed and heat-sealed at one end of a tube part in a length direction. In the first embodiment described above, the cutting lines L1 and L2 are formed at the intermediate layer 22 adjacent to the open one end 13*a* of the tube part 13, and the temporarily fixed seal part S is formed at the positions at which the cutting lines L1 and L2 are formed. However, the cutting lines may be formed close to the other end 13*b* of the tube part 13 which is blocked by heat sealing, and the temporarily fixed seal part may be formed at the positions at which the cutting lines are formed.

Second Embodiment

Figure 9:
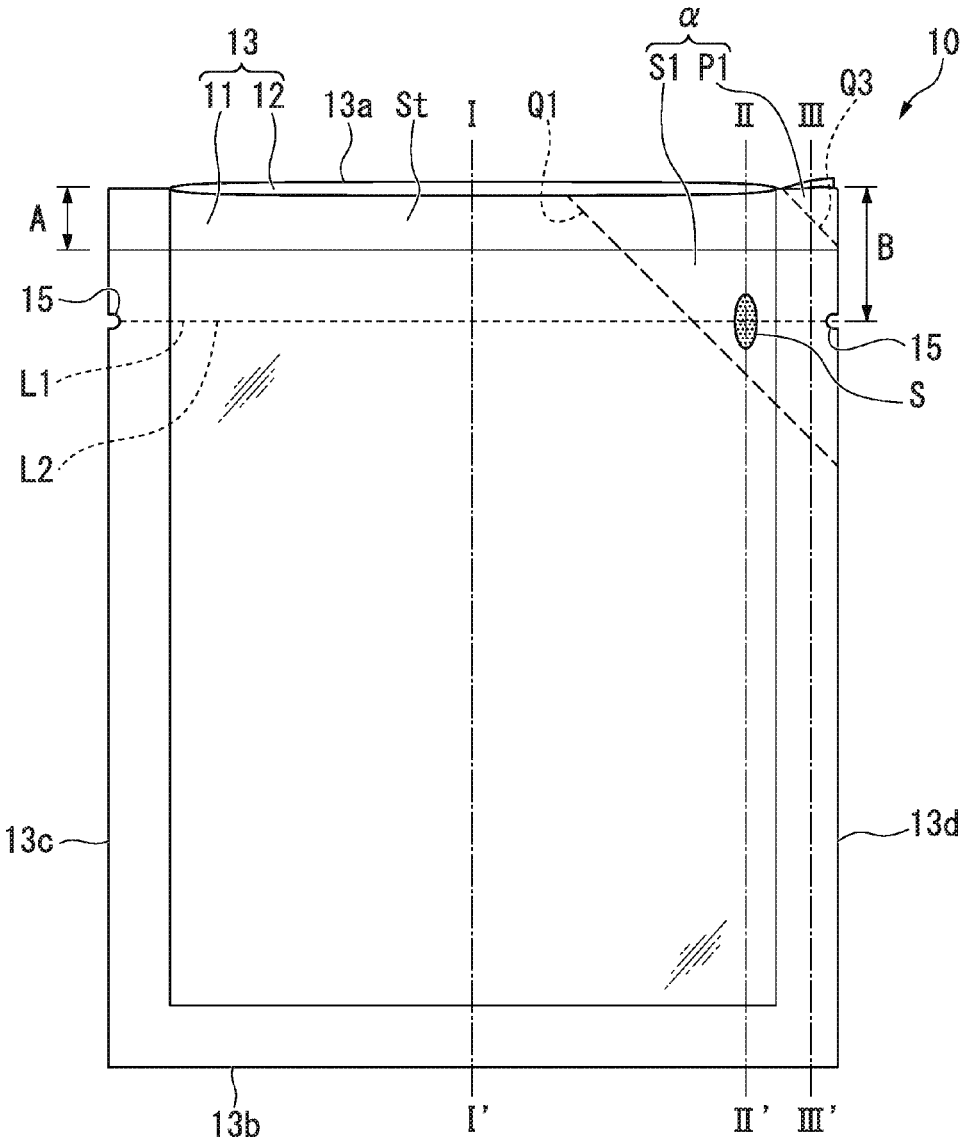
FIG. 9 is an appearance view illustrating a second embodiment of the packaging bag for microwave ovens of the present invention.
Figure 10:
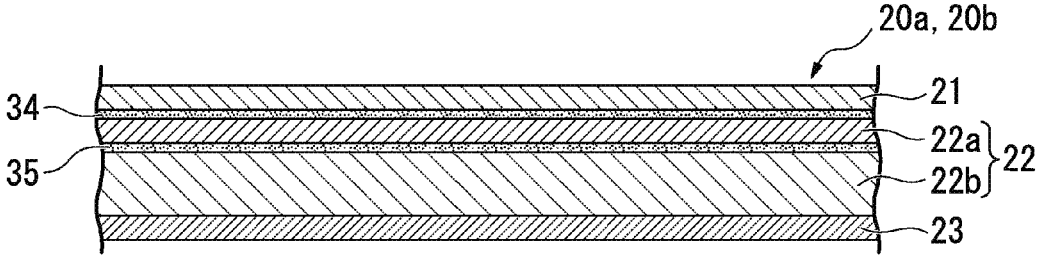
FIG. 10 is a cross-sectional view illustrating a layer constitution of a laminated film used to produce the packaging bag for microwave ovens of FIG. 9.
Figure 11:
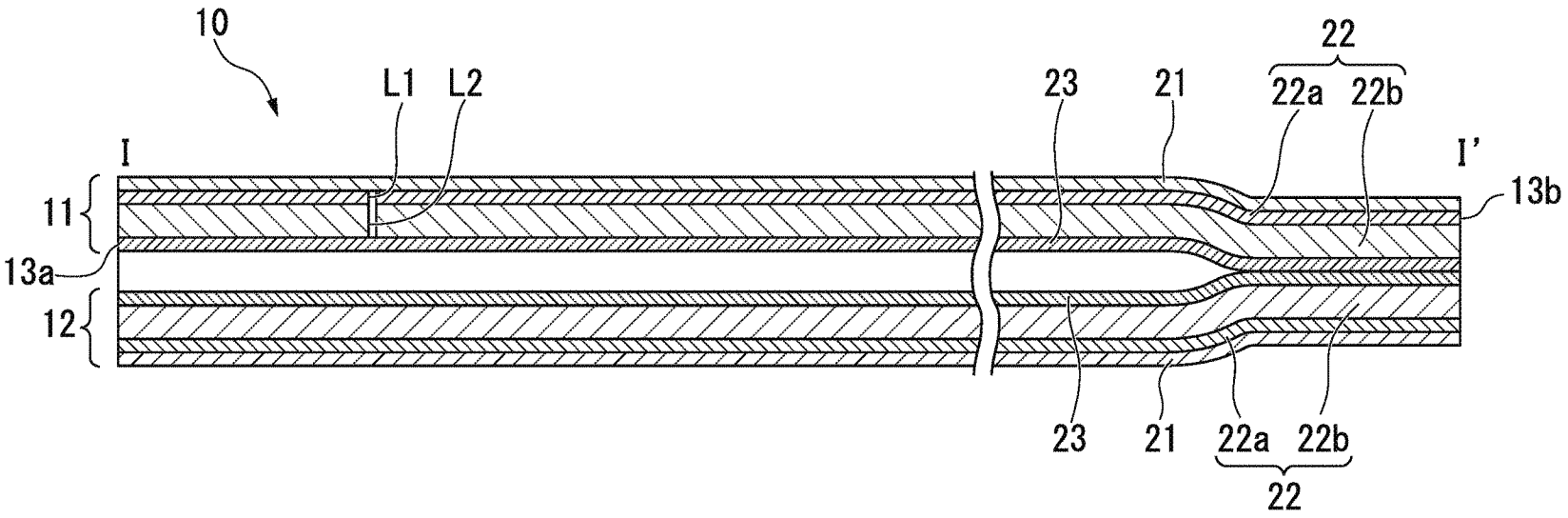
FIG. 11 is a cross-sectional view taken along line I-I' of FIG. 9.
Figure 12:
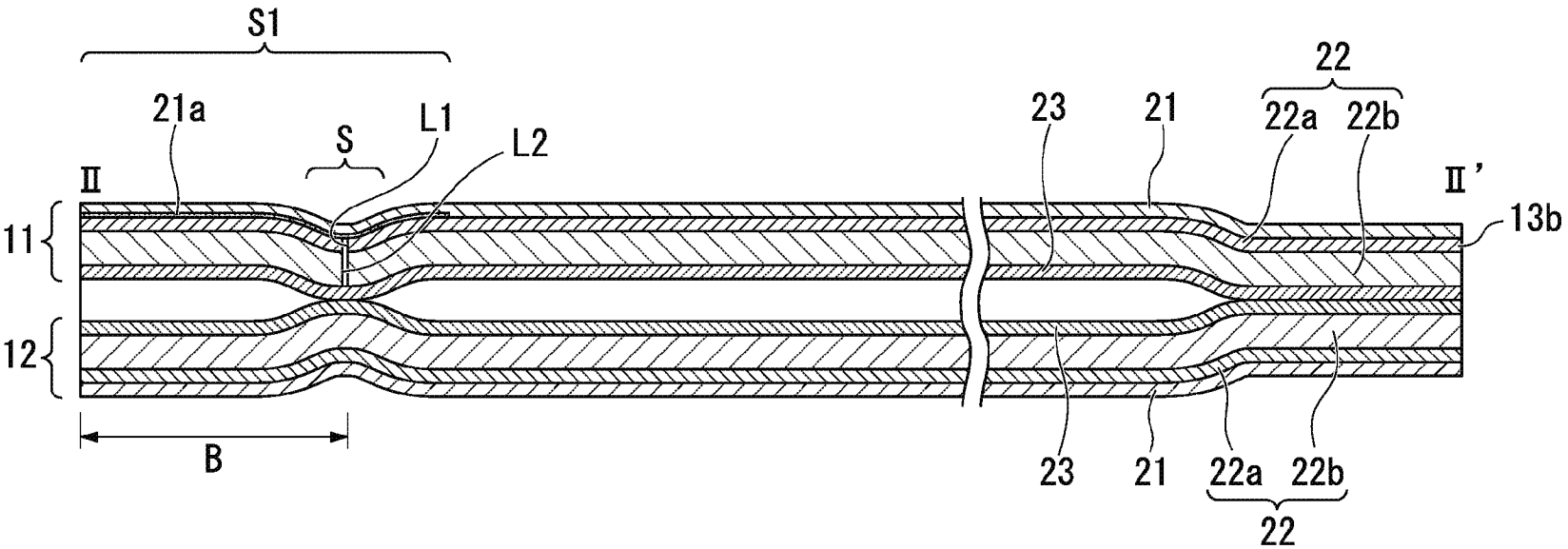
FIG. 12 is a cross-sectional view taken along line II-II' of FIG. 9.
Figure 13:
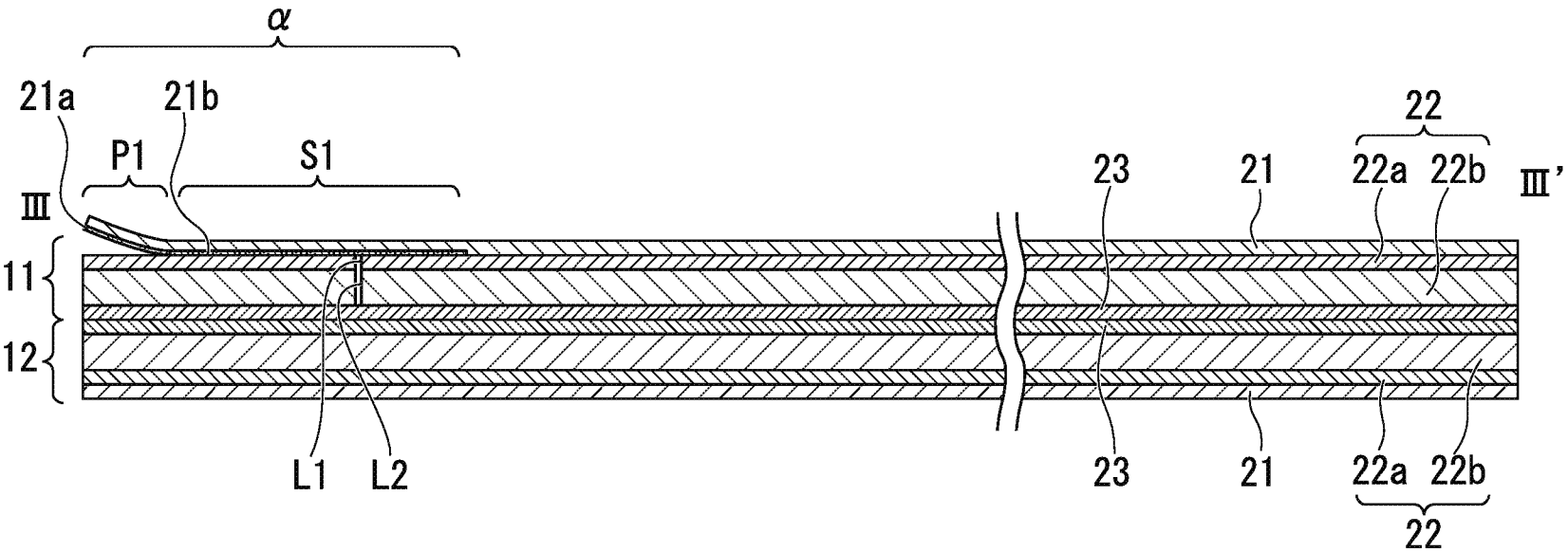
FIG. 13 is a cross-sectional view taken along line III-III' of FIG. 9.

Hereinafter, a second embodiment of the present invention will be described in detail. FIG. 9 is an appearance view illustrating a second embodiment of a packaging bag for microwave ovens (hereinafter referred to simply as "packaging bag") of the present invention, and FIG. 10 is a cross-sectional view illustrating a layer constitution of a laminated film used to produce the packaging bag of FIG. 9. FIG. 11 is a cross-sectional view taken along line I-I' of FIG. 9, and FIG. 12 is a cross-sectional view taken along line II-II' of FIG. 9. FIG. 13 is a cross-sectional view taken along line III-III' of FIG. 9. In the cross-sectional views of FIG. 11 and subsequent to FIG. 11, an adhesive agent layer is omitted from layers constituting the laminated film. In FIGS. 9 to 17 illustrating the second embodiment and its modifications, the same components as in the packaging bag 10 for microwave ovens in FIGS. 1 to 8 illustrating the first embodiment and its modifications are given the same reference signs.

The packaging bag 10 of FIG. 9 has a tube part 13 formed from a pair of rectangular resin film parts 11 and 12. As also illustrated in FIG. 11, one end (an upper end in FIG. 9) 13*a* of the tube part 13 in a length direction is open, and the other end (a lower end in FIG. 9) 13*b* is blocked by heat sealing. Note that the term "rectangular" used herein is a general term for a rectangle and a square. The open one end 13*a* is blocked by heat sealing after food to be heated is housed inside the packaging bag 10 therefrom. In this example, a region that is indicated by a reference sign St in FIG. 9 and has a length A from the one end 13*a* of the tube part 13 is a scheduled heat sealing region blocked by heat sealing after the food is housed therein.

The resin film parts 11 and 12 include laminated films 20*a* and 20*b* having a layer constitution illustrated in FIG. 10. The laminated films 20*a* and 20*b* of FIG. 10 each include a base material layer 21, a heat seal layer 23, and an intermediate layer 22 provided between these layers. The intermediate layer 22 may be made up of one layer or multiple layers. In this example, the intermediate layer 22 is made up of two layers, a first intermediate layer 22*a* located close to the base material layer 21 and a second intermediate layer 22*b* located close to the heat seal layer 23.

In this example, the base material layer 21 is a layer that is formed of a vapor deposited transparent PET film having a thickness of 12 μm and imparts strength and a gas barrier characteristic to the resin film parts 11 and 12. The vapor deposited transparent PET film is a transparent film in which a metal oxide or the like is vapor-deposited on at least one surface of the PET film and to which the gas barrier characteristic is imparted. The heat seal layer 23 is a sealant layer that is formed by extrusion lamination, is formed of polypropylene, and has a thickness of 20 μm. The first intermediate layer 22*a* is a layer that is formed of a biaxially oriented polyamide film having a thickness of 15 μm and imparts strength such as a pinhole resistance to the resin film parts 11 and 12. The second intermediate layer 22*b* is a layer that is formed of a non-oriented polypropylene film having a thickness of 50 μm and is joined with the heat seal layer 23 by thermal fusion.

The base material layer 21 and the first intermediate layer 22*a* are laminated via an adhesive agent layer 34. Similarly, the first intermediate layer 22*a* and the second intermediate layer 22*b* are also laminated via an adhesive agent layer 35. On the other hand, the heat seal layer 23 is formed on one surface of the second intermediate layer 22*b* by extrusion lamination, and no adhesive agent layer is provided between the heat seal layer 23 and the second intermediate layer 22*b*.

To be specific, as will be described below, in a rectangular laminated film 20*a* constituting the resin film part 11 of the resin film parts 11 and 12, a film in which a peeling coating and an adhesion inhibiting coating, which is not illustrated in FIG. 10, are juxtaposed on a surface of the base material layer 21 which is close to the first intermediate layer 22*a* is used at one of four corners.

Since the resin film parts 11 and 12 forming the packaging bag 10 of FIG. 9 have the heat seal layer 23 as described above, the resin film part 11 and the resin film part 12 are disposed opposite to each other such that the respective heat seal layers 23 become an inside thereof. The heat seal layers 23 disposed opposite to each other are formed in a bag shape as the other end 13*b* of the tube part 13 in the length direction and opposite ends (both lateral ends) 13*c* and 13*d* of the tube part 13 in a width direction are heat-sealed and blocked.

At the resin film part 11 of the resin film parts 11 and 12, continuous linear cutting lines L1 and L2 that extend in a width direction (a transverse direction in FIG. 9) of the resin film part 11 are formed at the first and second intermediate layers 22*a* and 22*b* at positions corresponding to each other, respectively. The cutting line L1 is formed by passing through the first intermediate layer 22*a* in a thickness direction, and the cutting line L2 is formed by passing through the second intermediate layer 22*b* in the thickness direction.

In this example, the cutting lines L1 and L2 are formed from one lateral end 13*c* to the other lateral end 13*d* of the resin film part 11 in the vicinity of the one end 13*a* of the tube part 13. For this reason, the cutting lines L1 and L2 of this example function as unsealing lines when food housed in the packaging bag 10 is removed. Reference signs 15 in FIG. 9 indicate notches that become unsealing start points formed at ends of the cutting lines L1 and L2. Here, the term "the vicinity of the one end of the tube part" is a region that has a length B of 30% from the one end 13*a* of the tube part 13 when a full length of the tube part 13 is set to 100% and that is closer to the center of the tube part 13 in the length direction than the scheduled heat sealing region St. The term "the vicinity of the other end of the tube part" is also a region that has a length of 30% from the other end 13*b* of the tube part 13 when a full length of the tube part 13 is set to 100% and that is closer to the center of the tube part 13 in the length direction than the scheduled heat sealing region St. The length 13 is preferably set, for instance, within a range of 10 to 50 mm. The length B is longer than the length A.

As illustrated in FIG. 9, at the resin film part 11 at which the cutting lines L1 and L2 are formed, a region (a specific region) a including a part of the edge thereof includes an easy peeling part S1 at which the base material layer 21 and the first intermediate layer 22*a* are weakly adhered to be peelable, and a peeling part P1 at which the base material layer 21 and the first intermediate layer 22*a* are peeled. To be specific, as will be described below, the easy peeling part S1 is a part at which a person who consumes food peels the base material layer 21 from the first intermediate layer 22*a* with his/her hands before the packaging bag 10 is heated by a microwave oven. The peeling part P1 guides a start of the peeling between the base material layer 21 and the first intermediate layer 22*a* at this easy peeling part S1 and namely has a function of a peeling start part for starting the peeling.

The peeling part P1 is formed in such a manner that a peeling coating 21*a* for preventing adhesion to the adhesive agent layer 34 is provided on a surface of the base material layer 21 which is close to the first intermediate layer 22*a*. Thereby, the base material layer 21 and the first intermediate layer 22*a* are peeled at the peeling part P1 without adhesion. On the other hand, the easy peeling part S1 is formed in such a manner that an adhesion inhibiting coating 21*b* for weakening an adhesive force of the adhesive agent layer 34 is provided on the surface of the base material layer 21 which is close to the first intermediate layer 22*a*. Thereby, the base material layer 21 and the first intermediate layer 22*a* are made peelable at the easy peeling part S1.

Both of the peeling coating 21*a* and the adhesion inhibition coating 21*b* are formed from a peeling agent containing at least one selected from the group consisting of a nitrocellulose, an acrylic resin, a polyamide resin, a silicone resin, and so on. A peel strength between the peeling coating 21*a* and the adhesive agent layer 34 and a peel strength between the adhesion inhibiting coating 21*b* and the adhesive agent layer 34 can be adjusted to be set within a proper range, for example, by methods (1) and (2) represented below. As the method (1), a peeling agent containing a silicone resin having a greater effect of impeding adhesion is used for the formation of the peeling coating 21*a*, and a peeling agent containing an acrylic resin having a smaller effect of impeding adhesion than the silicone resin is used for the formation of the adhesion inhibiting coating 21*b*. Thereby, a combination of the peeling agent used for the peeling coating 21*a* and the peeling agent used for the adhesion inhibition coating 21*b* is adjusted. As the method (2), the same type of peeling agent is used for the formation of the peeling coating 21*a* and the formation of the adhesion inhibiting coating 21*b*. However, an amount of application (per unit area) of the peeling agent at the peeling coating 21*a* for which the effect of impeding adhesion is further required is more than that of the peeling agent for forming the adhesion inhibiting coating 21*b*.

The other methods also include a method of, after the adhesion inhibiting coating for weakening the adhesive force of the adhesive agent layer 34 is formed on an overall region corresponding to the peeling part P1 and the easy peeling part S1 on the surface of the base material layer 21 which is close to the first intermediate layer 22*a*, mechanically peeling off the base material layer 21 and the adhesive agent layer 34 only on a region corresponding the peeling part P1, and forming the peeling part P1. In this case, even if the adhesion inhibiting coating formed on the overall region corresponding to the peeling part P1 and the easy peeling part S1 is formed to have uniform peel strength on the overall region, the region corresponding to the peeling part P1 may be formed such that the peel strength thereof is higher than that of a region corresponding to the easy peeling part S1.

A peel strength between the base material layer 21 and the first intermediate layer 22*a* at the easy peeling part S1 is preferably set within a range of 0.01 to 5 N/15 mm, and more preferably 0.1 to 3 N/15 mm. If the peel strength is equal to or higher than 0.01 N/15 mm, which is the lower limit of the range, the base material layer 21 and the first intermediate layer 22*a* of the easy peeling part S1 are not easily peeled when the packaging bag 10 goes through disinfection treatment by boiling or retorting after food is housed and sealed in the packaging bag 10 or when the packaging bag 10 is distributed after the disinfection treatment. On the other hand, if the peel strength is equal to or lower than 3 N/15 mm, which is the upper limit of the range, a user more easily peels the base material layer 21 and the first intermediate layer 22*a* of the easy peeling part S1 with his/her hands. The "peel strength" used therein indicates a value measured by a 180-degree peel test conforming to JIS K 6854.

In this example, the region α which includes the easy peeling part S1 and the peeling part P1 is a triangular region formed at one of four corners of the resin film part 11 that is in a rectangular shape. The peeling part P1 is a part closer to a tip side of the corner within the region α. The easy peeling part S1 is formed to be continuous with the peeling part P1, and is a trapezoidal region other than the peeling part P1 within the region α. In FIG. 9, a reference sign Q1 is a line indicating a boundary between the region α at the resin film part 11 and a region other than the region α, and a reference sign Q3 is a line indicating a boundary between the peeling part P1 and the easy peeling part S1.

As illustrated in FIG. 9, the peeling part P1 is preferably formed to fall within the scheduled heat sealing region St. Since the base material layer 21 is completely peeled from the intermediate layer 22 at the peeling part P1, a strength and a gas barrier characteristic according to the base material layer 21 are not obtained. If the peeling part P1 is formed to extend up to a housing portion in which food is housed without falling within the scheduled heat sealing region St, the base material layer 21 having the gas barrier characteristic is peeled, and thereby there is a possibility of leading to degradation of the housed food and insufficient strength. In addition, the easy peeling part S1 is provided such that, as the base material layer 21 thereof is peeled, the first intermediate layer 22*a* of a portion at which a temporarily fixed seal part S which will be described below is formed is exposed. For this reason, it is enough that the easy peeling part S1 be formed to be able to achieve this object, and it is not necessary that the easy peeling part S1 is provided with an area larger than necessary. The easy peeling part S1 is preferably provided with an area within a range of 30% or less, for example, when an area of the resin film part 11 is set to 100%, more preferably 20% or less, and most preferably 15% or less. If the area is within this range, even if the base material layer 21 of the easy peeling part S1 is peeled from the first intermediate layer 22*a* by a shock or the like during distribution, a reduction in a gas barrier characteristic, strength, etc. can be minimized.

As illustrated in FIG. 12, the temporarily fixed seal part S at which the heat seal layer 23 of the resin film part 11 and the heat seal layer 23 of the resin film part 12 are heat-sealed in a pointed shape is formed at one place at the positions at which the cutting lines L1 and L2 are formed. The temporarily fixed seal part S is located at the easy peeling part S1 of the region α. To be specific, as will be described below, when an internal pressure of the packaging bag 10 is raised by heating the packaging bag 10 with a microwave oven after food is housed therein and the scheduled heat sealing region St is blocked, the temporarily fixed seal part S is a part that functions as a vapor passing part at which a seal is broken and the internal pressure is released to the outside of the packaging bag 10. In this example, the temporarily fixed seal part S is formed in an oval shape in which a major diameter thereof in the length direction of the tube part 13 is about 6 mm, and a minor diameter perpendicular to the major diameter is about 4 mm.

The packaging bag 10 illustrated in FIG. 9 can be produced by a method having a process of producing the laminated film 20*a* constituting the resin film part 11 and the laminated film 20*b* constituting the resin film part 12, and a process of producing a bag from the produced laminated films 20*a* and 20*b*.

First, the laminated film 20*a* constituting the resin film part 11 at which the cutting lines L1 and L2 are formed is produced as follows. To be specific, a non-oriented polypropylene film is prepared. Next, a cutting line having a continuous linear shape is formed at a predetermined position (a position that is close to the one end 13*a* of the tube part 13) of the non-oriented polypropylene film. Thereby, the second intermediate layer 22*b* at which the cutting line L2 is formed is obtained. Next, polypropylene is extrusion-laminated to form the heat seal layer 23 on the one surface of the second intermediate layer 22*b* at which the cutting line L2 is formed. Thereby, a laminate (i) of the second intermediate layer 22*b* and the heat seal layer 23 is produced.

The process of forming the linear cutting line at the non-oriented polypropylene film and the process of extrusion-laminating the polypropylene may be continuously performed. That is, the non-oriented polypropylene film may be transported, the cutting line may be formed upstream in a flow direction of the non-oriented polypropylene film, and then the polypropylene may be extrusion-laminated downstream. In this case, the cutting line is formed in parallel with the flow direction of the non-oriented polypropylene film.

A vapor deposited transparent PET film is separately prepared. Next, the peeling coating 21*a* is formed at a corner (the region α) of one surface of the vapor deposited transparent PET film, and the adhesion inhibiting coating 21*b* is formed to be continuous with the peeling coating 21*a*. Thereby, the base material layer 21 having a region becoming the peeling part P1 and a region becoming the easy peeling part S1 is obtained. A biaxially oriented polyamide film is separately prepared, and a cutting line having a continuous linear shape is formed at a predetermined position (a position that is close to the one end 13*a* of the tube part 13) of the biaxially oriented polyamide film. Then, the vapor deposited transparent PET film is adhered to the biaxially oriented polyamide film by an adhesive agent (an adhesive agent corresponding to the adhesive agent layer 34), and a laminate (ii) of the base material layer 21 and the first intermediate layer 22*a* is produced. Here, a surface of the vapor deposited transparent PET film on which the peeling coating 21*a* and the adhesion inhibiting coating 21*b* are formed is adhered to face the biaxially oriented polyamide film. Afterwards, the second intermediate layer 22*b* of the laminate (i) and the first intermediate layer 22*a* of the laminate (ii) are adhered by an adhesive agent (an adhesive agent corresponding to the adhesive agent layer 35). In this way, the laminated film 20*a* constituting the resin film part 11 at which the cutting lines L1 and L2 are formed is produced.

The process of forming the linear cutting line at the biaxially oriented polyamide film and the process of adhering the vapor deposited transparent PET film to the biaxially oriented polyamide film with the adhesive agent may be continuously performed. That is, the biaxially oriented polyamide film may be transported, the cutting line may be formed upstream in a flow direction of the biaxially oriented polyamide film, and then the vapor deposited transparent PET film may be adhered downstream. In this case, the cutting line is formed by extending in parallel with the flow direction of the biaxially oriented polyamide film.

On the other hand, the laminated film 20*b* constituting the resin film part 12 can be produced by the same method as the laminated film 20*a* except that the cutting lines L1 and L2 are not formed and that the peeling coating 21*a* and the adhesion inhibiting coating 21*b* are not formed.

Next, the laminated films 20*a* and 20*b* are formed into a bag, and the packaging bag 10 of FIG. 9 is produced. First, the laminated film 20*a* and the laminated film 20*b* are superimposed on each other such that the heat seal layers 23 are opposite to each other. Next, among peripheral edges of the laminated films 20*a* and 20*b*, three peripheral edges (three sides) other than one peripheral edge (one side) corresponding to the one end 13*a* of the tube part 13 are blocked by heat sealing. At this point, point sealing is performed at a predetermined position except the blocked places, and a temporarily fixed seal part S is formed. Thereby, the packaging bag 10 illustrated in FIG. 9 can be produced.

After food is housed in the packaging bag 10 produced in this way, the scheduled heat sealing region St at the one end 13*a* of the tube part 13 is heat-sealed. Thereby, a food-containing packaging bag is obtained. The obtained food-containing packaging bag is distributed to a market.

Figure 14A:
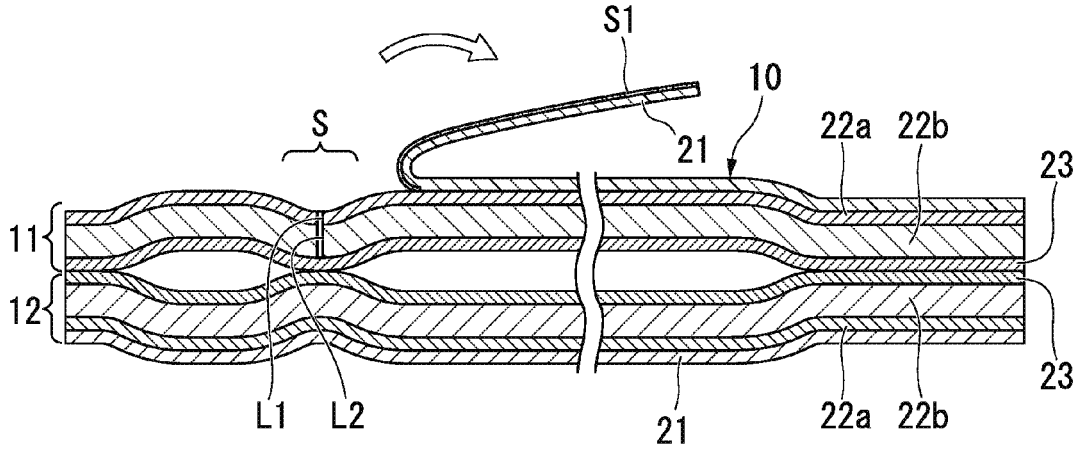
FIG. 14A is a cross-sectional view illustrating a procedure when the packaging bag for microwave ovens of FIG. 9 is heated by a microwave oven.
Figure 14B:
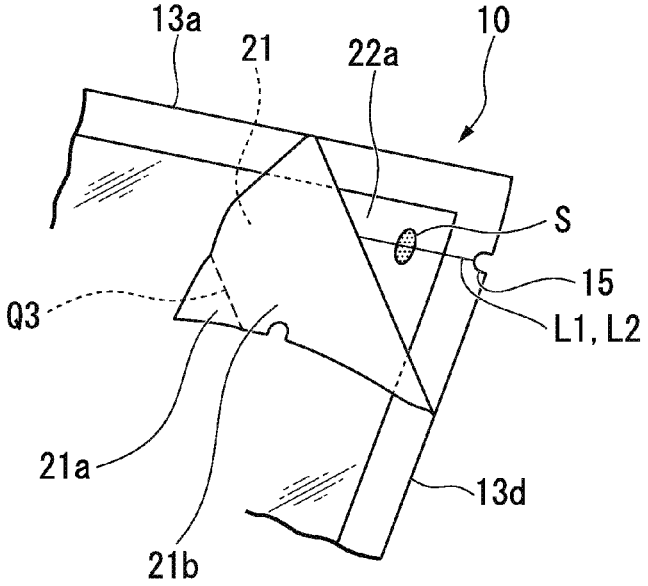
FIG. 14B is a perspective view illustrating the procedure when the packaging bag for microwave ovens of FIG. 9 is heated by a microwave oven.

When the food in the food-containing packaging bag is consumed, the food-containing packaging bag is heated by a microwave oven according to the following procedure. First, as illustrated in FIGS. 14A and 14B, a person who consumes the food picks up the base material layer 21 at the peeling part P1 of the region α with his/her hands (not shown) and peels the base material layer 21 of the easy peeling part S1 starting from this portion. Thereby, the first intermediate layer 22*a* of the portion at which the temporarily fixed seal part S is formed is exposed. Next, the person puts the food-containing packaging bag into the microwave oven, and starts heating.

Figure 15:
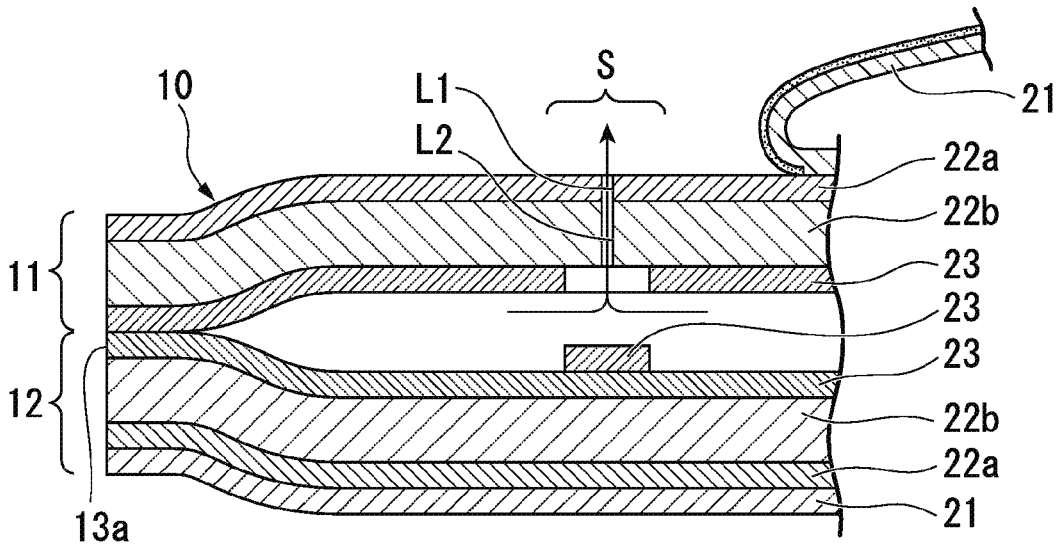
FIG. 15 is a cross-sectional view illustrating how water vapor generated from food inside the packaging bag for microwave ovens is discharged to the outside when the packaging bag for microwave ovens of FIG. 9 is heated by a microwave oven.

Then, as illustrated in FIG. 15, an internal pressure begins to be raised by water vapor or the like generated by the heating in the microwave oven. When the internal pressure is raised to a certain extent, stress is concentrated on the temporarily fixed seal part S inside the food-containing packaging bag. Thereby, the thermal fusion between the heat seal layers 23 at the temporarily fixed seal part S is broken. Here, since the heat seal layer 23 of the resin film part 11 and the heat seal layer 23 of the resin film part 12 are formed of the same resin, they are strongly joined. For this reason, when the thermal fusion of the temporarily fixed seal part S is broken, as illustrated in FIG. 15, peeling occurs not between the heat seal layer 23 of the resin film part 11 and the heat seal layer 23 of the resin film part 12, but between the second intermediate layer 22*b* of the resin film part 11 and the heat seal layer 23 of the resin film part 11 that is weakened by the formation of the cutting lines L1 and L2. That is, the heat seal layer 23 of the resin film part 11 at which the cutting lines L1 and L2 are formed is broken. To be specific, a part of the heat seal layer 23 of the resin film part 11 which is located at a portion corresponding to the cutting lines L1 and L2 is pulled by the heat seal layer 23 of the resin film part 12 which is strongly joined thereto and is peeled from the heat seal layer 23 of the resin film part 11. As a result, the peeled part of the heat seal layer 23 of the resin film part 11 is brought into a state in which it is transited from the heat seal layer 23 of the resin film part 11 at which the cutting lines L1 and L2 are formed to the heat seal layer 23 of the resin film part 12 at which the cutting lines L1 and L2 are not formed.

In this way, when the heat seal layer 23 of the resin film part 11 which is located at the portion corresponding to the cutting lines L1 and L2 is peeled at the temporarily fixed seal part S, the second intermediate layer 22*b* of the portion corresponding to the cutting lines L1 and L2 is exposed inside the packaging bag 10. As a result, the water vapor or the like generated inside the food-containing packaging bag passes through the cutting line L2 of the second intermediate layer 22*b*, the adhesive agent layer, illustration of which is omitted, the cutting line L1 of the first intermediate layer 22*a*, and the adhesive agent layer, illustration of which is omitted, as indicated by an arrow in FIG. 15. Thereby, the water vapor or the like generated by heating the food is discharged from the inside to the outside of the packaging bag 10.

For this reason, according to this packaging bag 10, even if the internal pressure is raised by the water vapor or the like generated from the food by the heating in the microwave oven, the packaging bag 10 does not burst. This water vapor or the like is not directly discharged to the outside of the packaging bag 10, but is automatically discharged to the outside of the packaging bag 10 after the internal pressure is raised to a certain extent since the water vapor or the like begins to be generated. For this reason, since heating and steaming effects caused by the water vapor are obtained, a taste is excellent. In the method of forming the temporarily fixed seal part S as the member for releasing the internal pressure in this way, it is not necessary to form a hole with, for instance, a punching device, and no excised piece (no released gas) occurs. Accordingly, troublesome work of collecting the excised piece is not required, and there is no risk of the excised piece being mixed into the packaging bag 10 that is a product.

To cause the generated water vapor or the like to pass through the cutting lines L1 and L2 to be released to the outside of the packaging bag 10, as described above, before a user heats the packaging bag 10 with the microwave oven, there is a need to peel the base material layer 21 at the easy peeling part S1. This peeling is performed just before the user heats the packaging bag 10 with the microwave oven. That is, during distribution of the food-containing packaging bag, the easy peeling part S1 is not peeled. For this reason, it is possible to suppress degradation of the food during distribution. Moreover, during distribution, it is possible to sufficiently protect the first and second intermediate layers 22*a* and 22*b* at which the cutting lines L1 and L2 are formed.

In the second embodiment described above, the intermediate layer 22 is formed from the two layers, the first intermediate layer 22*a* and the second intermediate layer 22*b*. The second intermediate layer 22*b* located close to the heat seal layer 23 is formed of the same type of resin as the heat seal layer 23, and is joined by thermal fusion with the heat seal layer 23 without interposing an adhesive agent layer. For this reason, as described above, when the thermal fusion of the temporarily fixed seal part S is broken, the second intermediate layer 22*b* is exposed, whereas an adhesive agent layer is not exposed. For this reason, even if the thermal fusion of the temporarily fixed seal part S is broken in this way, food does not come into contact with an adhesive agent layer, which is favorable from the viewpoint of food sanitation.

In the second embodiment described above, the cutting lines L1 and L2 also function as unsealing lines for unsealing the packaging bag 10 to take out the food. For this reason, when the packaging bag 10 is produced, the temporarily fixed seal part S may be provided on the cutting lines L1 and L2 functioning as the unsealing lines, and the cutting lines for the passage of steam may not be separately formed. However, the cutting lines may be provided separately from the unsealing lines, and the temporarily fixed seal part may be provided on the cutting lines. In this case, the cutting lines may be formed at the portion at which at least the temporarily fixed seal part is provided, and may not be formed from the one lateral end 13*c* to the other lateral end 13*d* of the resin film part 11.

In the second embodiment described above, the temporarily fixed seal part S is provided only at one place. The temporarily fixed seal part S may be provided at two or more places. However, when the temporarily fixed seal part S is provided only at one place in this way, the stress is effectively concentrated on the one temporarily fixed seal part S due to a rise in internal pressure, and the thermal fusion of the temporarily fixed seal part S is easily smoothly broken.

In the second embodiment described above, a shape of the temporarily fixed seal part S is an oval shape that is long in the length direction of the tube part 13, but the shape of the temporarily fixed seal part S is not limited to the oval shape.

The shape of the temporarily fixed seal part S may be another shape such as a completely circular shape, a rectangular shape, or the like. However, it is preferable that the shape of the temporarily fixed seal part S is a longitudinally long oval shape in this way, because, even if the position at which the temporarily fixed seal part S is provided in the event of the production of the packaging bag 10 is somewhat shifted in the length direction of the packaging bag 10, the temporarily fixed seal part S is easily formed to be located on the cutting lines L1 and L2. In addition, an area of the one temporarily fixed seal part S can be adequately set according to a size of the packaging bag 10, a type and amount of a content such as food, and so on, but it is preferably set within a range of 0.01 to 2 $cm^2$.

Figure 16A:
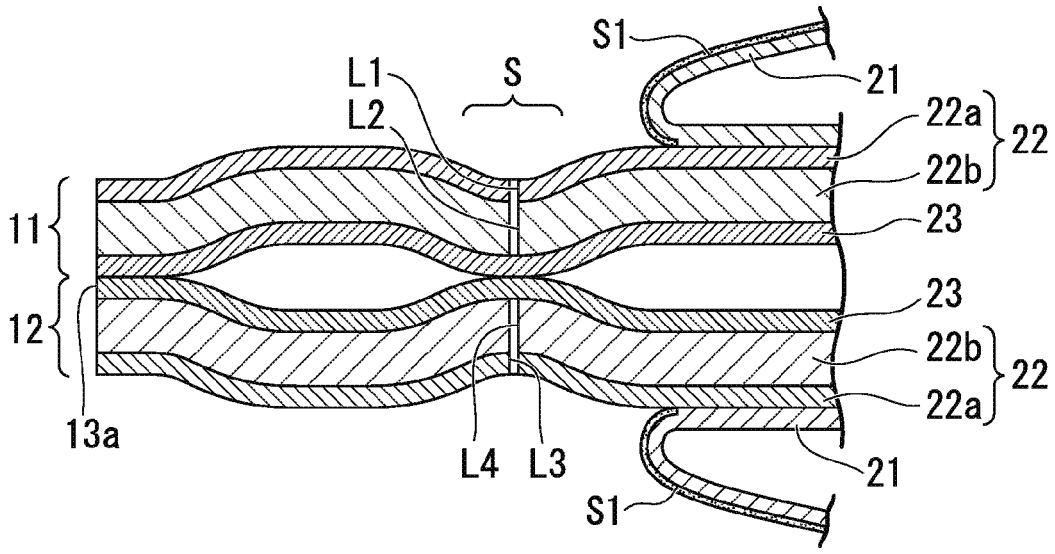
FIG. 16A is a cross-sectional view illustrating a procedure when a modification of the packaging bag for microwave ovens is heated by a microwave oven.

In the second embodiment described above, the cutting lines L1 and L2 are provided for the one resin film part 11. However, as illustrated in FIG. 16A, cutting lines L3 and L4 may also be provided for the intermediate layer 22 of the other resin film part 12. In this case, the cutting lines L1 and L2 at the one resin film part 11 and the cutting lines L3 and L4 at the other resin film part 12 are provided at positions corresponding to each other (positions opposite to each other in a direction orthogonal to the length and width directions of the tube part 13). The temporarily fixed seal part S is formed at each of the positions at which the cutting lines L1, L2, L3 and L4 of both of the resin film parts 11 and 12 are formed. The region α having the easy peeling part S1 is formed at each of the resin film parts 11 and 12. Before a food-containing packaging bag is heated by the microwave oven, as illustrated in FIG. 16A, the base material layer 21 of the easy peeling part S1 is peeled at each of the resin film parts 11 and 12. Thereby, the first intermediate layer 22*a* of the resin film part 11 and the first intermediate layer 22*a* of the resin film part 12 are exposed at the portions at which the temporarily fixed seal parts S are formed.

Figure 16B:
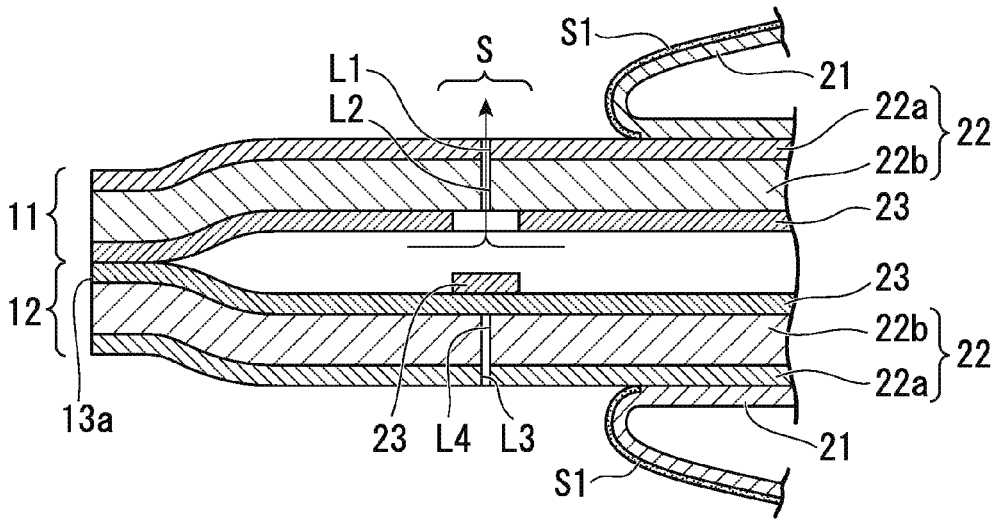
FIG. 16B is a cross-sectional view illustrating an example of how water vapor generated from food inside the packaging bag for microwave ovens is discharged to the outside when the packaging bag for microwave ovens of FIG. 16A is heated by a microwave oven.
Figure 16C:
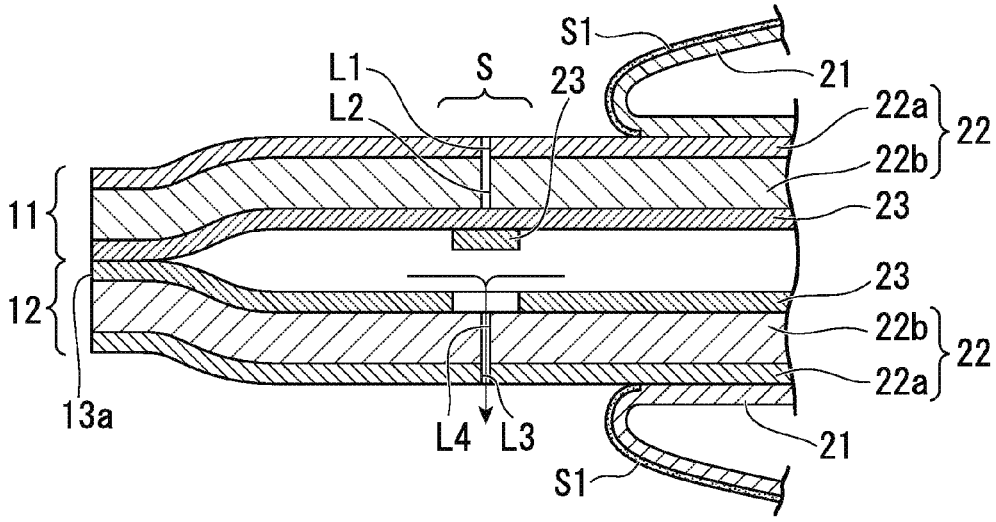
FIG. 16C is a cross-sectional view illustrating another example of how the water vapor generated from the food inside the packaging bag for microwave ovens is discharged to the outside when the packaging bag for microwave ovens of FIG. 16A is heated by a microwave oven.

In this way, when the cutting lines L1, L2, L3 and L4 are provided for both of the resin film parts 11 and 12, if the internal pressure of the packaging bag 10 is raised, the heat seal layer 23 is broken such that the second intermediate layer 22*b* at the resin film part 11 is exposed as illustrated in FIG. 16B, or the heat seal layer 23 is broken such that the second intermediate layer 22*b* at the resin film part 12 is exposed as illustrated in FIG. 16C. In the case of FIG. 16B, the water vapor or the like is discharged to the outside through the cutting lines L1 and L2. In the case of FIG. 16C the water vapor or the like is discharged to the outside through the cutting lines L3 and L4. In this way, when the cutting lines L1, L2, L3 and L4 are provided for both of the resin film parts 11 and 12, the water vapor or the like can be more reliably discharged to the outside of the packaging bag 10.

Figure 17:
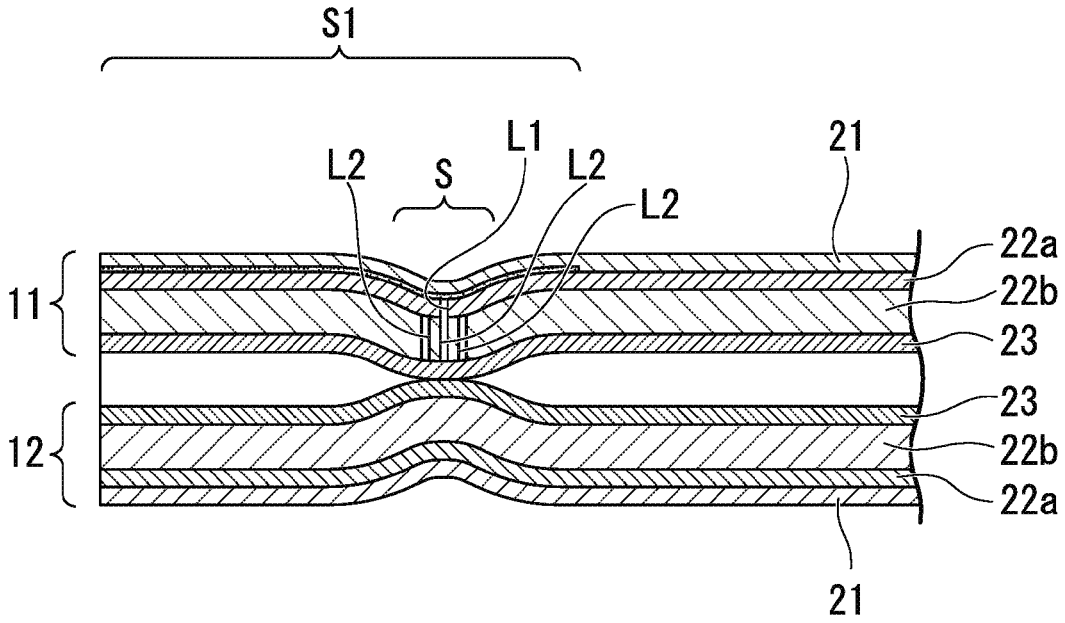
FIG. 17 is a cross-sectional view illustrating a modification of cutting lines formed at the packaging bag for microwave ovens.

Further, the cutting lines may be either intermittent cutting lines (perforations) such as dotted lines for which cut portions and uncut portions are alternately repeated, or continuous slit-like cutting lines made up of only cut portions. In this example, the cutting lines L1 and L2 are formed at the first and second intermediate layers 22*a* and 22*b*, respectively. However, the number of cutting lines formed at each of the first and second intermediate layers 22*a* and 22*b* is not limited to one, and may be two or more that are parallel to each other. Moreover, the number of cutting lines formed at the first intermediate layer 22*a* and the number of cutting lines formed at the second intermediate layer 22*b* may not be the same number. For example, as illustrated in FIG. 17, one cutting line L1 may be formed at the first intermediate layer 22*a*, and three cutting lines L2 may be formed at the second intermediate layer 22*b*. In this way, if a plurality of cutting lines L2 are formed at the second intermediate layer 22*b*, an adhesion strength between the heat seal layer 23 and a portion at which the cutting lines L2 are formed at the second intermediate layer 22*b* is made weaker than that between the heat seal layer 23 and a portion (an uncut line forming portion) at which the cutting lines are not formed at the second intermediate layer 22*b*. As a result, when the internal pressure is raised, it is easy for the peeling to occur reliably between the second intermediate layer 22*b* of the resin film part 11 and the heat seal layer 23 of the resin film part 11. In this way, when the plurality of cutting lines are formed at one or more of the first intermediate layer 22*a* and the second intermediate layer 22*b*, at least one of the cutting lines formed at the first intermediate layer 22*a* and at least one of the cutting lines formed at the second intermediate layer 22*b* need to be provided at mutually corresponding positions (positions opposite to each other in the direction orthogonal to the length and width directions of the tube part 13). Moreover, when the plurality of cutting lines are formed at one or more of the first intermediate layer 22*a* and the second intermediate layer 22*b*, an interval between neighboring cutting lines depends on a size of the temporarily fixed seal part S, but is preferably equal to or less than 2 mm. Both of the number of cutting lines formed at the first intermediate layer 22*a* and the number of cutting lines formed at the second intermediate layer 22*b* preferably range from one to five.

In the second embodiment described above, the vapor deposited transparent PET film is used for the base material layer 21, but the base material layer 21 is not limited thereto. For example, a film formed of polyester such as PET, polyamide, polypropylene, or the like may be used for the base material layer 21. Moreover, a multilayered film obtained by co-extruding two or more materials may be used. The film used for the base material layer 21 is preferably a biaxially oriented film from the viewpoint of strength, and so on. A vapor deposited film on which a metal oxide is vapor-deposited, or a barrier film for which a thin film layer having a gas barrier characteristic of, for instance, an ethylene-vinyl alcohol copolymer is provided may be used. A thickness of the film constituting the base material layer 21 is preferably set, for instance, within a range of 6 to 50 μm, and more preferably 9 to 30 μm.

In the second embodiment described above, the biaxially oriented polyamide film is used for the first intermediate layer 22*a*, but the first intermediate layer 22*a* is not limited thereto. For example, a film formed of polyester, polypropylene, or the like in addition to polyamide may be used for the first intermediate layer 22*a*. Moreover, a multilayered film obtained by co-extruding two or more materials may be used. The film used for the first intermediate layer 22*a* is preferably a biaxially oriented film from the viewpoint of strength, and so on. A vapor deposited film on which a metal oxide is vapor-deposited, or a barrier film for which a thin film layer having a gas barrier characteristic of, for instance, an ethylene-vinyl alcohol copolymer is provided may be used for the film used for the first intermediate layer 22*a*. A thickness of the film constituting the first intermediate layer 22*a* is preferably set, for instance, within a range of 6 to 50 μm, and more preferably 9 to 30 μm.

The adhesive agent constituting the adhesive agent layers 34 and 35 may include adhesive agents based on, for example, polyester, polyether, polyurethane, and so on.

Since the second intermediate layer 22*b* and the heat seal layer 23 are thermally fused to each other without interposing an adhesive agent layer, the second intermediate layer 22*b* and the heat seal layer 23 are preferably formed of polyolefin such as polypropylene, polyethylene, or the like. The second intermediate layer 22*b* and the heat seal layer 23 may be a multilayered film obtained by co-extruding two or more materials including polyolefin and so on. As described above, the heat seal layer 23 may be formed the on one surface of the second intermediate layer 22*b* by extrusion lamination. A thickness of the second intermediate layer 22*b* is preferably set within a range of 10 to 150 μm, and more preferably 20 to 100 μm. A thickness of the heat seal layer 23 is preferably set within a range of 10 to 100 μm, and more preferably 15 to 50 μm.

In the second embodiment described above, a four-sided sealed bag in which four edges (four sides) are finally sealed and blocked is shown as the packaging bag 10. However, the packaging bag 10 may be a bottom gusset bag, for example, in which a bottom member is disposed and heat-sealed at one end of a tube part in a length direction. In the first embodiment described above, the cutting lines L1 and L2 are formed at the intermediate layer 22 adjacent to the open one end 13*a* of the tube part 13, and the temporarily fixed seal part S is formed at the positions at which the cutting lines L1 and L2 are formed. However, the cutting lines may be formed close to the other end 13*b* of the tube part 13 which is blocked by heat sealing, and the temporarily fixed seal part may be formed at the positions at which the cutting lines are formed.

While the preferred embodiments of the present invention have been described, the present invention is not limited to these embodiments. Additions, omissions, substitutions, and other modifications of the constitution are possible without departing from the scope of the present invention. The present invention is not limited by the above description, but is only limited by the appended claims.

What is claimed is:

1. A packaging bag for microwave ovens, which has a tube part formed from a pair of resin film parts that each include a base material layer, a heat seal layer, and an intermediate layer provided between the base material layer and the heat seal layer and are disposed to face each other such that the heat seal layer becomes an inside thereof, wherein at least one of the pair of resin film parts includes:

a cutting line that is formed at the intermediate layer adjacent to one end or the other end of the tube part in a length direction and extends in a width direction of the resin film part; and a temporarily fixed seal part which is formed at a position at which the cutting line is formed and at which the heat seal layers of the pair of resin film parts are heat-sealed, a specific region including a part of an edge of the resin film part includes an easy peeling part at which the base material layer and the intermediate layer are weakly adhered, and the temporarily fixed seal part is located at the easy peeling part.

2. The packaging bag according to claim 1, wherein:

the easy peeling part includes a first region formed close to the edge of the resin film part and a second region having a lesser peel strength than the first region and formed to be continuous with the first region; and the temporarily fixed seal part is located at the second region.

3. The packaging bag according to claim 1, wherein the specific region includes: the easy peeling part; and a peeling part configured to guide a peeling of the easy peeling part and in which the base material layer and the intermediate layer are peeled.

4. The packaging bag according to claim 3, wherein:

the resin film part is rectangular; and the specific region is formed at one of corners of the resin film part.

5. The packaging bag according to claim 3, wherein the peeling part is formed by a peeling coating provided on a surface of the base material layer which is close to the intermediate layer.

6. The packaging bag according to claim 4, wherein the peeling part is formed by a peeling coating provided on a surface of the base material layer which faces the intermediate layer.

7. The packaging bag according to claim 1, wherein a peel strength of the easy peeling part is set within a range of 0.01 to 5 N/15 mm.

8. The packaging bag according to claim 1, wherein the packaging bag is a four-sided sealed bag.

9. The packaging bag according to claim 1, wherein the packaging bag is a bottom gusset bag which includes a bottom material that is disposed at the one end of the tube part in the length direction and is heat-sealed.

* * * * *